US008023847B2

(12) United States Patent
Toyama et al.

(10) Patent No.: US 8,023,847 B2
(45) Date of Patent: Sep. 20, 2011

(54) IMAGE FORMING APPARATUS AND IMAGE FORMING METHOD

(75) Inventors: Hiroshi Toyama, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 366 days.

(21) Appl. No.: 12/397,979

(22) Filed: Mar. 4, 2009

(65) Prior Publication Data

US 2009/0232533 A1 Sep. 17, 2009

(30) Foreign Application Priority Data

Mar. 11, 2008 (JP) ..... 2008-060477
Sep. 16, 2008 (JP) ..... 2008-236134

(51) Int. Cl.
*G03G 15/06* (2006.01)

(52) U.S. Cl. ..... 399/55; 399/57; 399/239

(58) Field of Classification Search ..... 399/38, 399/53, 55, 57, 233, 237–240
See application file for complete search history.

(56) References Cited

U.S. PATENT DOCUMENTS 6,600,884 B2 * 7/2003 Shimmura ..... 399/57
2004/0131372 A1 * 7/2004 Fujita et al. ..... 399/57

FOREIGN PATENT DOCUMENTS

JP 2007-114380 5/2007

* cited by examiner

*Primary Examiner* — David Porta
*Assistant Examiner* — Benjamin Schmitt
(74) *Attorney, Agent, or Firm* — DLA Piper LLP (US)

(57) ABSTRACT

An image forming apparatus includes an image carrier that is electrically charged and exposed to light to form a latent image that is developed by liquid developer. A first squeezing roller that is held in contact with the image carrier carrying a developed image bears bias voltage Vs1. A second squeezing roller that is held in contact with the image carrier squeezed by the first squeezing roller bears bias voltage Vs2. The image is transferred to a transfer member that is held in contact with the image carrier squeezed by the second squeezing roller. The absolute values of the bias voltages Vs1 and Vs2 have a relationship of |Vs1|>|Vs2|.

15 Claims, 10 Drawing Sheets

IMAGE FORMING APPARATUS AND IMAGE FORMING METHOD

CROSS REFERENCE TO RELATED APPLICATIONS

This application is based upon and claims the benefit of priority from the prior Japanese Patent Application Laid-Open No. 2008-60477, filed on Mar. 11, 2008 and Japanese Patent Application Laid-Open No. 2008-236134, filed on Sep. 16, 2008, the entire contents of which are incorporated herein by reference.

BACKGROUND OF THE INVENTION

1. Field of the Invention

The present invention relates to an image forming apparatus and an image forming method for forming an image by developing a latent image formed on an image carrier by means of a liquid developer consisting of toner and carrier, transferring the developed image onto a medium such as a sheet of recording paper and fusion-bonding the transferred toner image to and fixing it on the medium.

2. Description of the Related Art

There have been proposed various wet type image forming apparatus designed to develop an electrostatic latent image to visualize the latent image by means of a highly viscous liquid developer, which is prepared by dispersing solid toner in a liquid solvent. The developer to be used for such a wet type image forming apparatus is prepared by suspending solid (toner particles) in a highly viscous organic solvent (carrier liquid) that is typically made of silicon oil, mineral oil, edible oil or the like and electrically insulating and the toner particles are very fine and have a particle size of about 1 μm. Thus, the wet type image forming apparatus can produce high quality images if compared with dry type image forming apparatus designed to employ powdery toner particles having a particle size of about 7 μm.

While the image forming apparatus designed to use a liquid developer as described above can produce high quality images, they are accompanied by problems to be dissolved. For example, the image forming apparatus designed to use a liquid developer has a problem of difficulty of controlling the liquid developer on the photosensitive member (image carrier) and many of the rollers thereof such as development rollers because the developer is liquid. More specifically, the liquid developer on such a roller may flow to the opposite end facets of the roller and/or form a liquid ring on the roller.

To cope with the problem of forming a liquid ring, JP 2007-114380-A (Patent Document 1) discloses an image carrier squeezing device for collecting surplus liquid developer. The proposed image carrier squeezing device is so designed as to be arranged at the downstream side of the nip section of an image carrier 10Y and a development roller 20Y disposed opposite to the image carrier 10Y in order to collect the surplus liquid developer from the toner image produced on the image carrier 10Y as a result of a developing process. It includes an image carrier squeezing roller 13Y that is an elastic roller member having an elastic body 13-1 as a surface coat and held in contact with the image carrier 10Y and a cleaning blade 14Y pressed against and held in contact with the image carrier squeezing roller 13Y to clean the surface of the squeezing roller 13Y. It is adapted to collect the surplus carrier C and the unnecessary fogging toner T" from the developer D used for the developing process executed on the image carrier 10Y to raise the toner particle content ratio in the visible image.

SUMMARY OF THE INVENTION

However, while a predetermined bias voltage is applied to the image carrier squeezing roller of the device described in the Patent Document 1 in order to collect the unnecessary fogging toner T", the Patent Document 1 is accompanied by a problem that it does not disclose the proper level of the bias voltage.

According to the present invention, the above problem is dissolved by providing an image forming apparatus including: an image carrier that carries an image; a charging section that electrically charges the image carrier; an exposure section that exposes the image carrier to light to form a latent image; a development section that develops the latent image by means of a liquid developer containing carrier and toner particles; a first squeezing roller that is held in contact with the image carrier carrying the image developed by the development section and adapted to bear a bias voltage $Vs_1$ applied thereto; a second squeezing roller that is held in contact with the image carrier squeezed by the first squeezing roller adapted to bear a bias voltage $Vs_2$ applied thereto; and a transfer member that is held in contact with the image carrier squeezed by the second squeezing roller and adapted to receive the image transferred thereto; an absolute value of the bias voltage $Vs_1$ and an absolute value of the bias voltage $Vs_2$ showing a relationship of $|Vs_1|>|Vs_2|$.

In another aspect of the present invention, there is provided an image forming apparatus including: an image carrier that carries an image; a charging section that electrically charges the image carrier; an exposure section that exposes the image carrier to light to form a latent image; a development section that includes a developer carrier held in contact with the image carrier to develop the latent image by means of a liquid developer containing carrier and toner particles and adapted to bear a development bias voltage Vd applied thereto; a first squeezing roller that is held in contact with the image carrier carrying the image developed by the developer carrier and adapted to bear a bias voltage $Vs_1$ applied thereto; a second squeezing roller that is held in contact with the image carrier squeezed by the first squeezing roller and adapted to bear a bias voltage $Vs_2$ applied thereto; and a transfer member held in contact with the image carrier squeezed by the second squeezing roller and adapted to receive the image transferred thereto; a absolute value of the development bias voltage Vd, a absolute value of the bias voltage $Vs_1$ and a absolute value of the bias voltage $Vs_2$ showing a relationship of $||Vd|-|Vs_1||>||Vs_1|-|Vs_2||$.

Preferably, the image forming apparatus according to the present invention as defined above further includes a temperature detector that detects temperature; and a bias voltage adjuster that shifts the bias voltage $Vs_1$ according to the temperature detected by the temperature detector.

Preferably, in the image forming apparatus according to the present invention as defined above, a second bias voltage adjustor that shifts the bias voltage $Vs_2$ according to the temperature detected by the temperature detector.

Preferably, in the image forming apparatus according to the present invention as defined above, a quantity of a shift in the bias voltage $Vs_1$ is greater than a quantity of a shift in the bias voltage $Vs_2$.

Preferably, the image forming apparatus according to the present invention as defined above further includes a rotational speed regulator that regulates a rotational speed of the image carrier.

Preferably, in the image forming apparatus according to the present invention as defined above, the bias voltage adjustor that changes the bias voltage $Vs_1$ according to the rotational speed of the image carrier regulated by the rotational speed regulator.

Preferably, in the image forming apparatus according to the present invention as defined above, the second bias voltage adjustor changes the bias voltage $Vs_2$ according to the rotational speed of the image carrier regulated by the rotational speed regulator.

Preferably, in the image forming apparatus according to the present invention as defined above, the bias voltage adjustor that increases the absolute value $|Vs_1|$ of the bias voltage in response to an increase of the rotational speed of the image carrier.

Preferably, the image forming apparatus according to the present invention as defined above further includes a third squeezing roller that is held in contact with the image carrier squeezed by the second squeezing roller and adapted to bear a bias voltage $Vs_3$ applied thereto, the absolute value of the bias voltage $Vs_1$, the absolute value of the bias voltage $Vs_2$ and a absolute value of the bias voltage $Vs_3$ showing a relationship of $|Vs_1|>|Vs_2|>|Vs_3|$.

In another aspect of the present invention, there is provided an image forming method including: electrically charging an image carrier at a charging section; forming a latent image by exposing the image carrier to light at an exposure section; developing the latent image by means of a liquid developer containing carrier and toner particles at a development section having a development roller held in contact with the image carrier; squeezing the image carrier that carries an image developed by the development roller by means of a first squeezing roller bearing a bias voltage $Vs_1$ applied thereto; and squeezing the image carrier squeezed by the first squeezing roller by means of a second squeezing roller bearing a bias voltage $Vs_2$ applied thereto, a absolute value of the bias voltage $Vs_1$ and a absolute value of the bias voltage $Vs_2$ showing a relationship of $|Vs_1|>|Vs_2|$.

Preferably, the image forming method according to the present invention as defined above detects temperature by means of a temperature detector; and shifting the bias voltage $Vs_1$ and the bias voltage $Vs_2$ according to the temperature detected by the temperature detector.

Preferably, in the image forming method according to the present invention as defined above, a quantity of a shift in the bias voltage $Vs_1$ is greater than a quantity of a shift in the bias voltage $Vs_2$.

Preferably, the image forming method according to the present invention as defined above regulating a rotational speed of the image carrier by means of a rotational speed regulator; and shifting the bias voltage $Vs_1$ and the bias voltage $Vs_2$ according to the rotational speed of the image carrier regulated by the rotational speed regulator.

Preferably, in an image forming method according to the present invention as defined above, a quantity of the shift in the bias voltage $Vs_1$ is greater than the quantity of the shift in the bias voltage $Vs_2$.

Thus, the image forming apparatus and a method of controlling the image forming apparatus according to the present invention can efficiently remove the unnecessary fogging toner by means of the squeezing rollers bearing an appropriate bias voltage applied thereto.

Additionally, the image forming apparatus and the image forming method according to the present invention can remove the fogging toner in harmony with the rate of attenuation of the electric potential of the image carrier.

The conductive characteristics of the photosensitive member, or the image carrier, of the image forming apparatus changes as a function of temperature and the rate of attenuation of the electric potential is high when temperature is high. However, the image forming apparatus and the image forming method according to the present invention can appropriately remove the fogging toner by taking such a change into consideration and reducing the bias voltages when temperature is high.

Additionally, since the rate of attenuation of the electric potential of the first squeezing roller due to temperature is greater than the rate of attenuation of the electric potential of the second squeezing roller due to temperature, the image forming apparatus and the image forming method according to the present invention can effectively remove the fogging toner by shifting the electric potential of the first squeezing roller more than the electric potential of the second squeezing roller.

Additionally, the image forming apparatus and the image forming method according to the present invention can effectively remove the fogging toner by means of appropriate bias voltages that are adjusted in response to the change in the printing speed (which is proportional to the rotational speed of the image carrier) according to the type of the recording medium being used for forming an image and other factors.

Still additionally, the image forming apparatus and the image forming method according to the present invention can effectively remove the fogging toner by changing the electric potential of the first squeezing roller more than the electric potential of the second squeezing roller because the quantity of attenuation of electric potential is greater at the upstream squeezing roller than at the downstream squeezing roller when the printing speed (which is proportional to the rotational speed of the image carrier) is varied.

A reference embodiment as described below is an effective arrangement for the purpose of the present invention. This reference embodiment of image forming apparatus according to the present invention includes: an image carrier of amorphous silicon photoconductor; a charging means for electrically charging the surface of the image carrier; an exposure means for exposing the surface of the image carrier to light to form an electrostatic latent image thereon; a development roller to be held in contact with the surface of the image carrier so as to develop the electrostatic latent image formed thereon by means of a liquid developer containing carrier and toner particles and form a developed image; a transfer means for transferring the developed image formed on the surface of the image carrier onto a predetermined medium; and a pair of squeezing rollers that is arranged between the downstream side of the development roller and the transfer means so as to be held in contact with the surface of the image carrier and respectively bears predetermined bias voltages applied thereto; the bias voltages showing a relationship of $Vs_1>Vs_2$, $Vs_1$ being the bias voltage applied to the squeezing roller arranged immediately downstream relative to the development roller, $Vs_2$ being the bias voltage applied to the squeezing roller arranged immediately downstream relative to the squeezing roller bearing the bias voltage $Vs_1$ applied thereto.

Another reference embodiment of image forming apparatus according to the present invention includes: an image carrier of amorphous silicon photoconductor; a charging means for electrically charging the surface of the image carrier; an exposure means for exposing the surface of the image carrier to light to form an electrostatic latent image thereon; a development roller to be held in contact with the surface of the image carrier so as to develop the electrostatic latent image formed thereon by means of a liquid developer containing carrier and toner particles and form a developed image; a transfer means for transferring the developed image formed on the surface of the image carrier onto a predetermined medium; and a pair of squeezing rollers that is arranged between the downstream side of the development roller and the transfer means so as to be held in contact with the surface of the image carrier and respectively bears predetermined bias voltages applied thereto; the bias voltages showing a relationship of $|Vd-Vs_1|>|Vs_1-Vs_2|$, Vd being the bias voltage applied to the development roller, $Vs_1$ being the bias voltage applied to the squeezing roller arranged immediately downstream relative to the development roller, $Vs_2$ being the bias voltage applied to the squeezing roller arranged immediately downstream relative to the squeezing roller.

Preferably, either of the reference embodiments of image forming apparatus according to the present invention as defined above further includes a temperature detection means for detecting temperature and is adapted to shift $Vs_1$ and $Vs_2$ according to the temperature detected by the temperature detection means.

Preferably, either of the reference embodiments of image forming apparatus according to the present invention as defined above is adapted to make the quantity of the change in the bias voltage $Vs_1$ greater than the quantity of the change in the bias voltage $Vs_2$ when it shifts $Vs_1$ and $Vs_2$ according to the temperature detected by the temperature detection means.

Preferably, either of the reference embodiments of image forming apparatus according to the present invention as defined above is adapted to shift $Vs_1$ and $Vs_2$ according to the rotational speed of the image carrier.

Preferably, either of the reference embodiments of image forming apparatus according to the present invention as defined above is adapted to make the quantity of the change in the bias voltage $Vs_1$ greater than the quantity of the change in the bias voltage $Vs_2$ when it shifts $Vs_1$ and $Vs_2$ according to the rotational speed of the image carrier.

Still another reference embodiment of image forming apparatus according to the present invention includes: an image carrier of amorphous silicon photoconductor; a charging means for electrically charging the surface of the image carrier; an exposure means for exposing the surface of the image carrier to light to form an electrostatic latent image thereon; a development roller to be held in contact with the surface of the image carrier so as to develop the electrostatic latent image formed thereon by means of a liquid developer containing carrier and toner particles and form a developed image; a transfer means for transferring the developed image formed on the surface of the image carrier onto a predetermined medium; and m (m being a natural number not smaller than 3) or more than m squeezing rollers arranged between the downstream side of the development roller and the transfer means so as to be held in contact with the surface of the image carrier and respectively bear predetermined bias voltages applied thereto; the bias voltages showing a relationship of $Vs_{n-1}>Vs_n$, $Vs_n$ being the bias voltage of the n-th (n being a natural number defined by $n \leqq m$) squeezing roller as counted from the side of the development roller.

A control method of controlling any of the reference embodiments of image forming apparatus according to the present invention, the apparatus including: an image carrier of amorphous silicon photoconductor; a charging means for electrically charging the surface of the image carrier; an exposure means for exposing the surface of the image carrier to light to form an electrostatic latent image thereon; a development roller to be held in contact with the surface of the image carrier so as to develop the electrostatic latent image formed thereon by means of a liquid developer containing carrier and toner particles and form a developed image; a transfer means for transferring the developed image formed on the surface of the image carrier onto a predetermined medium; and a pair of squeezing rollers that is arranged between the downstream side of the development roller and the transfer means so as to be held in contact with the surface of the image carrier and respectively bears predetermined bias voltages applied thereto; the method controls the bias voltages so as to make them satisfy a relationship of $Vs_1>Vs_2$, where $Vs_1$ is the bias voltage applied to the squeezing roller arranged immediately downstream relative to the development roller and $Vs_2$ is the bias voltage applied to the squeezing roller arranged immediately downstream relative to the squeezing roller bearing the bias voltage $Vs_1$ applied thereto.

Thus, the reference embodiments of image forming apparatus according to the present invention and the control method of controlling any of the reference embodiments of image forming apparatus can efficiently remove the unnecessary fogging toner by means of the squeezing rollers bearing an appropriate bias voltage applied thereto.

Additionally, the reference embodiments of image forming apparatus according to the present invention and the control method of controlling any of the reference embodiments of image forming apparatus can remove the fogging toner in harmony with the rate of attenuation of the electric potential of the image carrier.

The conductive characteristics of the amorphous silicon photoconductor of any of the reference embodiments of image forming apparatus changes as a function of temperature and the rate of attenuation of the electric potential is high when temperature is high. However, the reference embodiments of image forming apparatus according to the present invention and the control method of controlling any of the reference embodiments of image forming apparatus can appropriately remove the fogging toner by taking such a change into consideration and reducing the bias voltages when temperature is high.

Additionally, since the rate of attenuation of the electric potential of the second squeezing roller due to temperature is greater than the rate of attenuation of the electric potential of the first squeezing roller due to temperature, the reference embodiments of image forming apparatus according to the present invention and the control method of controlling any of the reference embodiments of image forming apparatus can effectively remove the fogging toner by shifting the electric potential of the second squeezing roller more than the electric potential of the first squeezing roller.

Additionally, the reference embodiments of image forming apparatus according to the present invention and the control method of controlling any of the reference embodiments of image forming apparatus can effectively remove the fogging toner by means of appropriate bias voltages that are adjusted in response to the change in the printing speed (which is proportional to the rotational speed of the image carrier) according to the type of the recording medium being used for forming an image and other factors.

Still additionally, the reference embodiments of image forming apparatus according to the present invention and the control method of controlling any of the reference embodiments of image forming apparatus can effectively remove the fogging toner by changing the electric potential of the first squeezing roller more than the electric potential of the second squeezing roller because the quantity of attenuation of electric potential is greater at the upstream squeezing roller than at the downstream squeezing roller when the printing speed (which is proportional to the rotational speed of the image carrier) is varied.

DETAILED DESCRIPTION OF THE PREFERRED EMBODIMENTS

Figure 1:
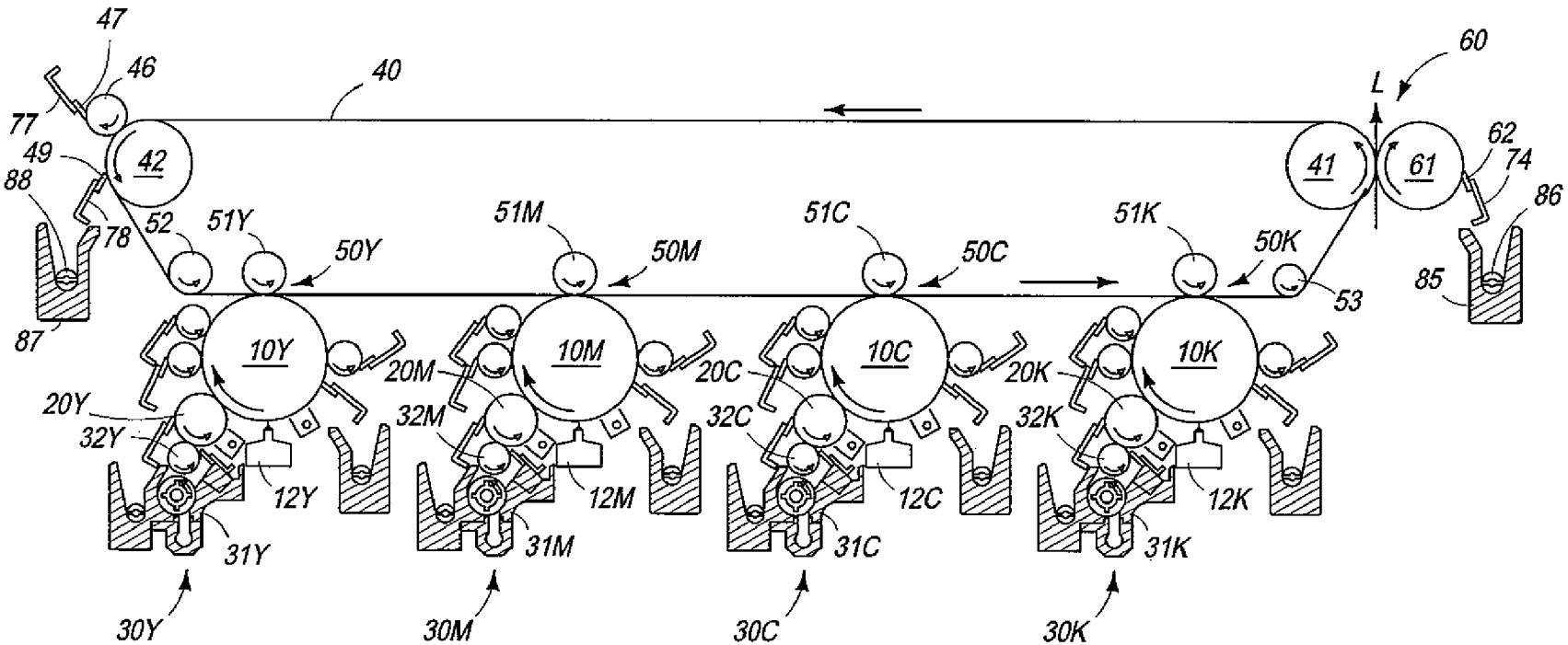
FIG. 1 is a schematic illustration of an image forming apparatus according to an embodiment of the present invention, showing principal components thereof.

Now, preferred embodiments of the present invention will be described in greater detail by referring to the accompanying drawings. FIG. 1 is a schematic illustration of an embodiment of image forming apparatus according to the present invention, showing principal components thereof. Image forming sections of different colors are arranged in a central part of the image forming apparatus and development devices 30Y, 30M, 30C and 30K are arranged in a lower part of the image forming apparatus, while an intermediate transfer body 40 and a secondary transfer section (secondary transfer unit) 60 are arranged in an upper part of the image forming apparatus.

The image forming sections include image carriers 10Y, 10M, 10C and 10K, corona chargers 11Y, 11M, 11C and 11K and exposure units 12Y, 12M, 12C and 12K (not shown). The exposure units 12Y, 12M, 12C and 12K by turn include LED arrays, drivers IC and wiring substrates. The image carriers 10Y, 10M, 10C and 10K are electrically uniformly charged by the respective corona chargers 11Y, 11M, 11C and 11K and electrostatic latent images are formed respectively on the electrically charged image carriers 10Y, 10M, 10C and 10K by means of the exposure units 12Y, 12M, 12C and 12K under control according to the input image signals.

The development devices 30Y, 30M, 30C and 30K respectively include development rollers 20Y, 20M, 20C and 20K, developer containers (reservoirs) 31Y, 31M, 31C and 31K for containing liquid developers of yellow (Y), magenta (M), cyan (C) and black (K) and anilox rollers 32Y, 32M, 32C and 32K for applying liquid developers of these colors to the development rollers 20Y, 20M, 20C and 20K from the developer containers 31Y, 31M, 31C and 31K. The electrostatic latent images formed on the image carriers 10Y, 10M, 10C and 10K are developed by liquid developers of the respective colors.

The intermediate transfer body 40 is an endless belt wound around a drive roller 41 and tension rollers 42, 52 and 53. It is driven to rotate by the drive roller 41 while being held in contact with the image carriers 10Y, 10M, 10C and 10K respectively at the primary transfer sections 50Y, 50M, 50C and 50K. The primary transfer sections 50Y, 50M, 50C and 50K respectively have primary transfer rollers 51Y, 51M, 51C and 51K arranged vis-à-vis the image carriers 10Y, 10M, 10C and 10K with the intermediate transfer body 40 interposed between them. The developed toner images on the image carriers 10Y, 10M, 10C and 10K are sequentially transferred onto the intermediate transfer body 40 one on the other at the respective transfer positions that are the contact positions of the primary transfer rollers 51Y, 51M, 51C and 51K and the image carriers 10Y, 10M, 10C and 10K to produce a full color toner image.

The secondary transfer unit 60 includes a secondary transfer roller 61 arranged vis-à-vis the belt drive roller 41 with the intermediate transfer body 40 interposed between them and a cleaning device including a secondary transfer roller cleaning blade 62. The monochromatic toner image or the full color toner image formed on the intermediate transfer body 40 is transferred at the transfer position where the secondary transfer roller 61 is arranged onto a recording medium, which may be a sheet of paper, film or cloth, conveyed to the transfer position by way of a sheet member conveyance route L.

A fixing unit (not shown) is arranged downstream relative to the sheet member conveyance route L so that the monochromatic toner image or the full color toner image transferred onto the recording medium such as a sheet of paper is then fusion-bonded to and fixed on the recording medium.

The intermediate transfer body 40 is wound around the belt drive roller 41 and the tension roller 42. A cleaning device that includes an intermediate transfer body cleaning roller 46 is arranged and held in contact with the intermediate transfer body 40 at the position where the intermediate transfer body 40 is wound around the tension roller 42.

Figure 2:
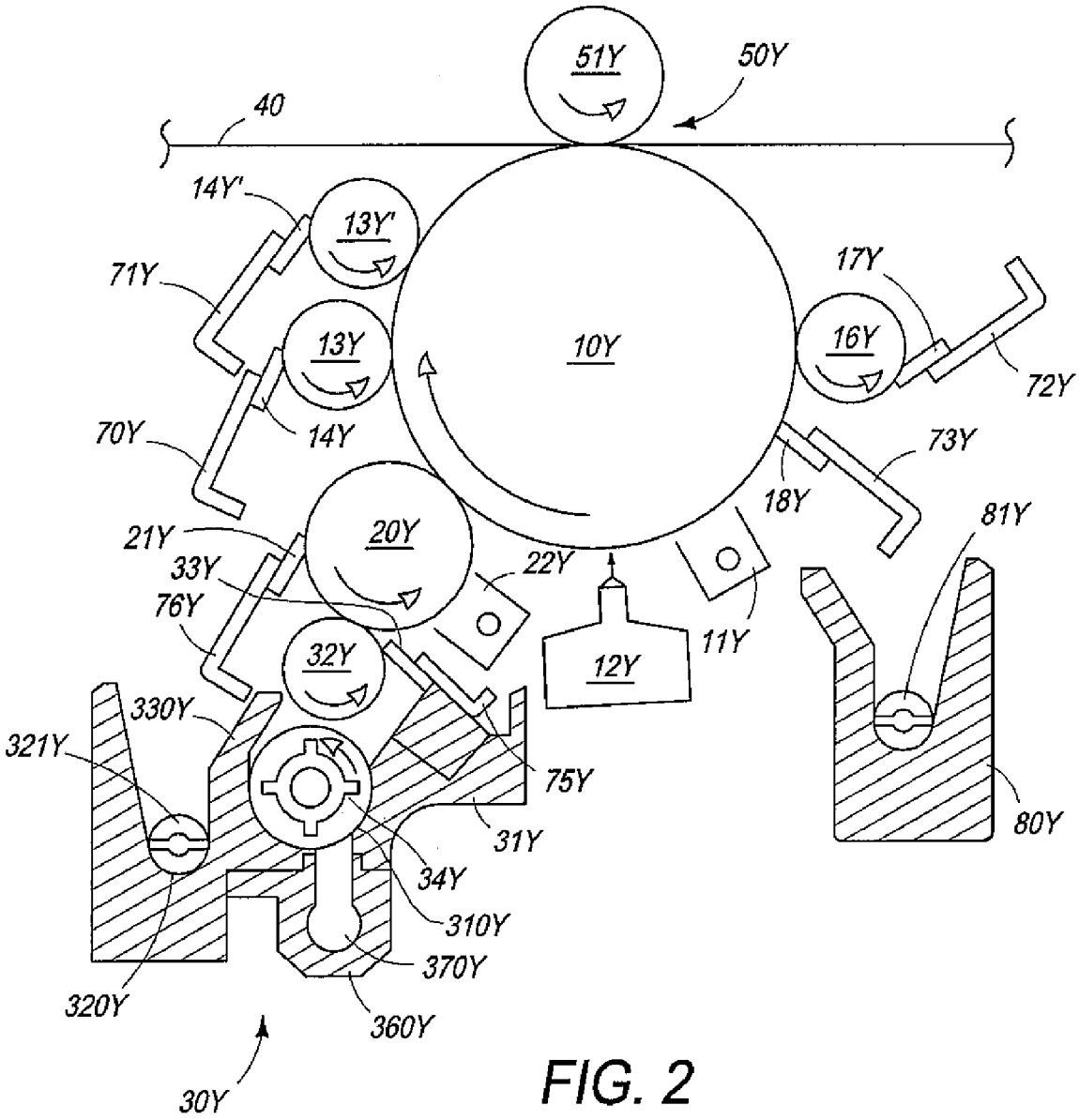
FIG. 2 is a schematic cross-sectional view of an image forming section and a development device, showing principal components thereof.

Now, the image forming sections and the development devices of the image forming apparatus according to this embodiment of the present invention will be described below. FIG. 2 is a schematic cross-sectional view of an image forming section and a development device, showing principal components thereof. Since the image forming sections and the development devices of the four colors are structurally same, only the yellow (Y) image forming section and the yellow (Y) development device will be described.

An image carrier cleaning roller 16Y, an image carrier cleaning blade 18Y, the corona charger 11Y, the exposure unit 12Y, the development roller 20Y of the development device 30Y, a first image carrier squeezing roller 13Y and a second image carrier squeezing roller 13Y' are arranged in the image forming section along the outer periphery of the image carrier 10Y in the above mentioned order in the sense of rotation of the image carrier 10Y.

The image carrier cleaning roller 16Y is a roller having a urethane surface layer and adapted to clean the image carrier 10Y by removing the liquid developer left there without being transferred as it is driven to rotate counterclockwise while being held in contact with the image carrier 10Y. A bias voltage is applied to the image carrier cleaning roller 16Y so as to attract toner particles in liquid developer. Thus, the image carrier cleaning roller 16Y collects liquid developer containing toner particles to a large extent. The solid-rich liquid developer collected by the image carrier cleaning roller 16Y is then scraped off by image carrier cleaning roller cleaning blade 17Y that is held in contact with the image carrier cleaning roller 16Y and falls right down.

On the other hand, the image carrier cleaning blade 18Y that is held in contact with the image carrier 10Y at the downstream side of the image carrier cleaning roller 16Y drives the carrier-rich liquid developer on the image carrier 10Y to fall down by way of a cleaning blade holding member 73Y.

Note that the expression of solid-rich refers to the state of liquid developer that contains solid to a large extent if compared with the state of the liquid developer supplied to the development device 30Y. On the other hand, the expression of carrier-rich refers to the state of liquid developer that contains carrier to a large extent if compared with the state of the liquid developer supplied to the development device 30Y. Liquid developer (toner) is defined as developer where solid (toner particles) are dispersed in carrier.

The solid-rich liquid developer that is made to fall from the image carrier cleaning roller cleaning blade 17Y and the carrier-rich liquid developer that is scraped off by the image carrier cleaning blade 18Y mix with each other at the cleaning blade holding member 73Y so as to become highly conveyable. Such highly conveyable liquid developer allows the apparatus to be downsized.

Image carrier collecting reservoir section 80Y has a recessed section for receiving both the solid-rich liquid developer scraped off by the image carrier cleaning roller cleaning blade 17Y and the carrier-rich liquid developer scraped off by the image carrier cleaning blade 18Y.

The recessed section of the image carrier collecting reservoir section SOY is provided with a collecting screw 81Y. As the collecting screw 81Y is driven to rotate, the spiral blade of the screw conveys the liquid developer received by the recessed section in the axial direction of the collecting screw 81Y. The liquid developer is conveyed by the collecting screw 81Y so as to be sent out to a collecting mechanism (not shown).

Reference symbols 70Y, 71Y, 72Y and 73Y denote so many cleaning blade holding members for respectively holding the corresponding cleaning blades.

A cleaning blade 21Y, an anilox roller 32Y and a compaction corona generator 22Y are arranged along the outer periphery of the development roller 20Y in the development device 30Y. A limiting blade 33Y is held in contact with the anilox roller 32Y to adjust the quantity of liquid developer being supplied to the development roller 20Y. Reference symbol 75Y denotes a blade holding member for holding the limiting blade 33Y. An auger 34Y and a collecting screw 321Y are contained in the liquid developer container 31Y.

The primary transfer roller 51Y of the primary transfer section is arranged along the intermediate transfer body 40 at a position located vis-à-vis the image carrier 10Y.

The image carrier 10Y is a photosensitive drum that is a cylindrical member having a photosensitive layer formed on the outer periphery thereof and showing a width greater than the development roller 20Y. It is typically driven to rotate clockwise as shown in FIG. 2. The photosensitive layer, or the surface layer, of the image carrier 10Y is made of amorphous silicon photoconductor. The corona charger 11Y is arranged at the upstream side relative to the nip section of the image carrier 10Y and the development roller 20Y in the sense of rotation of the image carrier 10Y and adapted to corona-charge the image carrier 10Y as a voltage is applied thereto from a power source (not shown). The exposure unit 12Y irradiates a laser beam onto the image carrier 10Y that is corona-charged by the corona charger 11Y at the downstream side of the corona charger 11Y in the sense of rotation of the image carrier 10Y to form a latent image on the image carrier 10Y.

Note that the rollers and other components that are more anterior are defined to be arranged upstream relative to the rollers and other components that are more posterior in the course of the image forming process of the image forming apparatus according to the present invention.

The development device 30Y has compaction corona generator 22Y for producing an compaction effect and a developer container 31Y containing liquid developer where toner particles are dispersed in carrier to show a weight ratio of about 20%. The developer container 31Y is provided with a collecting screw 321Y for collecting liquid developer not supplied to the anilox roller 32Y.

Thus, the development device 30Y has a development roller 20Y for carrying liquid developer, an anilox roller 32Y that is an application roller for applying liquid developer to the development roller 20Y, a limiting blade 33Y for limiting the quantity of liquid developer being applied to the development roller 20Y, an auger 34Y for agitating and conveying liquid developer so as to convey it to the anilox roller 32Y, a compaction corona generator 22Y for bringing the liquid developer carried by the development roller 20Y into a compacted state and a development roller cleaning blade 21Y for cleaning the development roller 20Y. Reference symbol 76Y denotes a cleaning blade holding member for holding the development roller cleaning blade 21Y.

The liquid developer contained in the developer container 31Y is not popular volatile liquid developer that is volatile at room temperature, that shows a low carrier concentration (about 1 to 2 wt %) and a low viscosity and that contains Isopar (trademark: available from Exxon) as carrier but high concentration and high viscosity liquid developer that is non-volatile at room temperature. More specifically, the liquid developer to be used for the purpose of the present invention is a high viscosity (of about 30 to 10,000 mPa·s) liquid developer prepared by adding solid particles having an average particle size of 1 μm and formed by dispersing a coloring agent such as a pigment into thermoplastic resin to a liquid solvent selected from an organic solvent, silicon oil, mineral oil and edible oil with a dispersant so as to make the concentration of toner solid equal to about 20%.

The auger 34Y in the liquid developer container 31Y is arranged so as to be separated from the anilox roller 32Y. Liquid developer is supplied to the anilox roller 32Y as the auger 34Y is driven to rotate counterclockwise as shown in FIG. 2.

The space inside the developer container 31Y is divided into two spaces by a partition section 330Y. One of the spaces produced by the partition section 330Y is utilized as supply reservoir section 310Y for supplying liquid developer, whereas the other space is utilized as collecting reservoir section 320Y for collecting liquid developer. The supply reservoir section 310Y and the collecting reservoir section 320Y are separated by the partition section 330Y so as to be arranged side by side in the axial direction.

The auger 34Y is arranged in the supply reservoir section 310Y so as to be able to rotate. As the auger 34Y is driven to rotate in an operation of the apparatus, liquid developer is supplied from the supply reservoir section 310Y to the anilox roller 32Y. The supply reservoir section 310Y is linked to a liquid developer supply pipe 370Y so that liquid developer is supplied to the supply reservoir section 310Y by way of the liquid developer supply pipe 370Y.

The collecting screw 321Y is arranged in the collecting reservoir section 320Y so as to be able to rotate. The liquid developer not used for development and the carrier dropped from the cleaning blades including the image carrier squeezing roller cleaning blades 14Y, 14Y' are collected as the collecting screw 321Y is driven to rotate in an operation of the apparatus.

The collecting reservoir section 320Y and the liquid developer collecting pipe 371Y are linked to each other and, as the collecting screw 321Y is driven to rotate, liquid developer is conveyed to one of the opposite ends of the collecting reservoir section 320Y to which the liquid developer collecting pipe 371Y is linked. The liquid developer that is collected by the collecting reservoir section 320Y in this way is then LED to a liquid developer recycling mechanism (not shown) by way of the liquid developer collecting pipe 371Y.

The anilox roller 32Y functions as application roller for supplying and applying liquid developer to the development roller 20Y. The anilox roller 32Y is a cylindrical member having projections and recesses on the surface that are produced by fine and uniform helical grooves formed on the surface so as to allow the surface to easily carry liquid developer. Thus, liquid developer is supplied from the developer container 31Y to the development roller 20Y by means of the anilox roller 32Y. When the apparatus is in operation, the auger 34Y is driven to rotate clockwise as shown in FIG. 2 and supplies liquid developer to the anilox roller 32Y. Then, the anilox roller 32Y is driven to rotate counterclockwise and applies the liquid developer to the development roller 20Y.

The limiting blade 33Y is an elastic blade formed by arranging an elastic member on the surface of a metal plate and hence includes a rubber section held in contact with the surface of the anilox roller 32Y and made of urethane rubber or the like and a metal plate supporting the rubber section. The limiting blade 33Y limits and adjusts the film thickness and the quantity of liquid developer carried and conveyed by the anilox roller 32Y to adjust the quantity of liquid developer to be supplied to the development roller 20Y.

The development roller cleaning blade 21Y has a rubber section held in contact with the surface of the development roller 20Y and is arranged at the downstream side relative to the development nip section where the development roller 20Y contacts the image carrier 10Y in the sense of rotation of the development roller 20Y so as to scrape off and remove the liquid developer remaining on the development roller 20Y.

The compaction corona generator 22Y is an electrode field application means for increasing the charged bias on the surface of the development roller 20Y. An electric field is applied to the liquid developer that is being conveyed by the development roller 20Y at a compaction site by the compaction corona generator 22Y as shown in FIG. 2 in a direction toward the development roller 20Y from the compaction corona generator 22Y.

The electric field application means for compaction that can be used for the purpose of the present invention may not necessarily be a corona discharger as shown in FIG. 2. In other words, the corona discharger may be replaced by a compaction roller. A compaction roller may be a cylindrical member formed as an elastic roller having an elastic coat just like the development roller 20Y, including a conductive resin layer or rubber layer on the surface layer of a metal roller base material, and adapted to be driven to rotate clockwise, or in the sense of rotation opposite to the sense of rotation of the development roller 20Y.

On the other hand, the compacted developer that is being carried by the development roller 20Y is developed in correspondence to the latent image of the image carrier 10Y as a desired electric field is applied thereto at the development nip section where the development roller 20Y contacts the image carrier 10Y. The developer that is left after the development operation is scraped off and removed by the development roller cleaning blade 21Y and dropped into the collecting section in the developer container 31Y for reuse. The carrier and the toner to be reused in this way is not in a mixed color condition.

The image carrier squeezing device is arranged vis-à-vis the image carrier 10Y at the upstream side relative to the primary transfer position and at the downstream side relative to the development roller 20Y. It is for collecting surplus developer left after the development operation on the image carrier 10Y. As shown in FIG. 2, the image carrier squeezing device includes a first image carrier squeezing roller 13Y and a second image carrier squeezing roller 13Y' that are elastic roller members having an elastic surface coat and held in contact with the image carrier 10Y so as to be driven to rotate and cleaning blades 14Y, 14Y' respectively held in contact with the first image carrier squeezing roller 13Y and the second image carrier squeezing roller 13Y' under pressure in order to clean the surfaces of the squeezing rollers 13Y and 13Y'. The image carrier squeezing device has a function of collecting surplus carrier and unnecessary fogging toner from the developer left on the image carrier 10Y after a development operation so as to raise the ratio of toner particles in the visible image. While a plurality of image carrier squeezing rollers 13Y and 13Y' are arranged for the image carrier squeezing device that is adapted to operate before a primary transfer operation in this embodiment, they may be replaced by a single image carrier squeezing roller. One of the image carrier squeezing rollers 13Y and 13Y' may be so arranged as to be removably held in contact with the image carrier 10Y and adapted to be moved away from the image carrier 10Y depending on the condition of the liquid developer there.

Any unnecessary fogging toner is removed and collected as bias voltages showing appropriate values are respectively applied to the first image carrier squeezing roller 13Y and the second image carrier squeezing roller 13Y'. The bias voltages that are applied to them will be described in greater detail hereinafter.

At the primary transfer section 50Y, the developed developer image on the image carrier 10Y is transferred onto the intermediate transfer body 40 by the primary transfer roller 51Y. The image carrier 10Y and the intermediate transfer body 40 are adapted to move at a same rotational speed to reduce the drive load for driving them to move and rotate and suppress the effect of external turbulence on the visible toner image on the image carrier 10Y.

The intermediate transfer body 40 passes the nips of the primary transfer sections 50 of the four different colors of yellow (Y), magenta (M), cyan (C) and black (K), where the developed images on the image carriers of the different colors are transferred onto the intermediate transfer body 40 and laid one on the other before it gets into the nip section of the secondary transfer unit 60.

After passing the secondary transfer unit 60, the intermediate transfer body 40 keeps on rotating so as to receive the images to be transferred at the primary transfer sections 50 once again. Additionally, the intermediate transfer body 40 is cleaned by the intermediate transfer body cleaning roller 46 and other related members at the upstream side of each of the primary transfer sections 50.

The intermediate transfer body 40 has a three-layer structure formed by arranging an elastic intermediate layer of polyurethane on a polyimide base layer and a PFA surface layer on the intermediate layer. The intermediate transfer body 40 is wound around the drive roller 41 and the tension rollers 42, 52 and 53 with the polyimide base layer held in contact with those rollers so that toner images are transferred onto the PFA surface layer. The elastic intermediate transfer body 40 having the above-described structure can follow the surface profile of a recording medium highly responsively. In other words, the intermediate transfer body 40 can effectively drive toner particles having a very small particle size to get into recesses of the recording medium in the secondary transfer operation.

Figure 3:
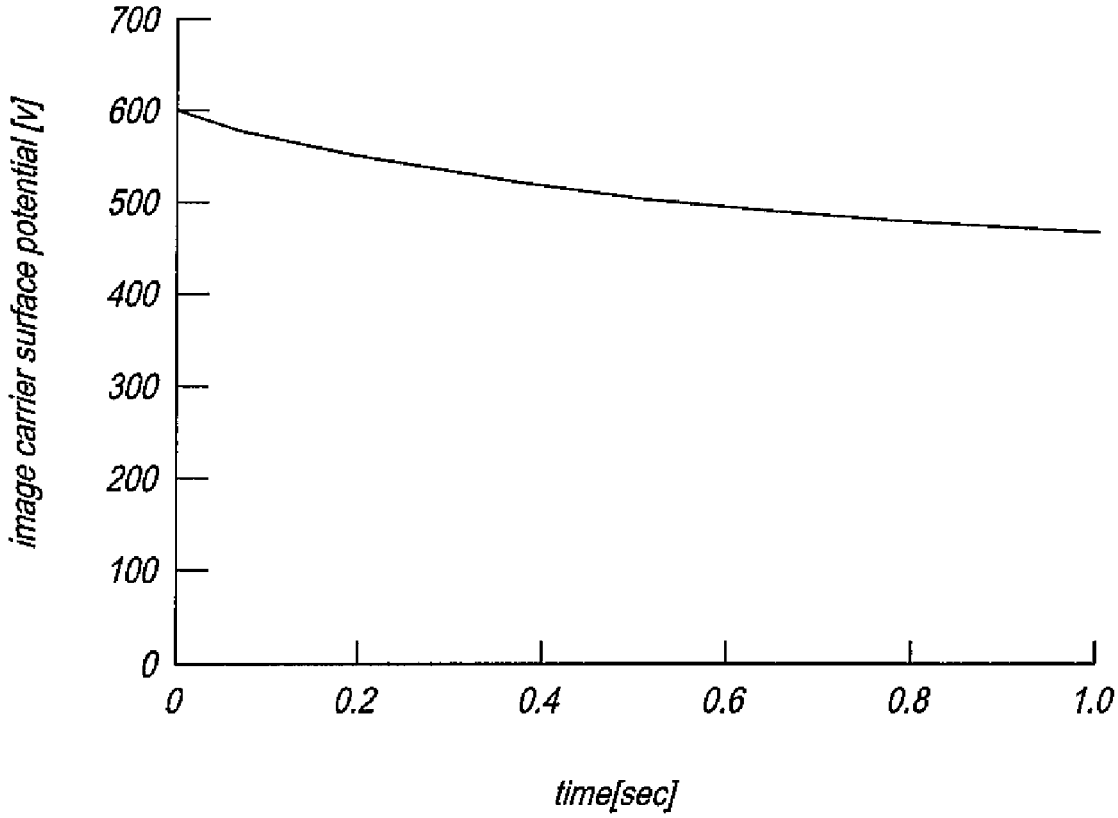
FIG. 3 is a graph illustrating the dark decay characteristic of the image carrier of the image forming apparatus according to the embodiment of the present invention.

Now, the change with time of the surface potential of the image carrier 10Y that is an amorphous silicon photoconductor will be described below. FIG. 3 is a graph illustrating the dark decay characteristic of the image carrier 10Y of the image forming apparatus according to the embodiment of the present invention. FIG. 3 shows the change with time of the surface potential after the image carrier 10Y is electrically charged to 600 V in a dark place. As seen from FIG. 3, the image carrier 10Y that is an amorphous silicon photoconductor gradually loses its electric potential even in a dark place after it is electrically charged to a predetermined potential level. Such a characteristic of electric potential is referred to as dark decay characteristic. Such dark decay is remarkable in the initial stages and becomes less remarkable as time passes.

Figure 4:
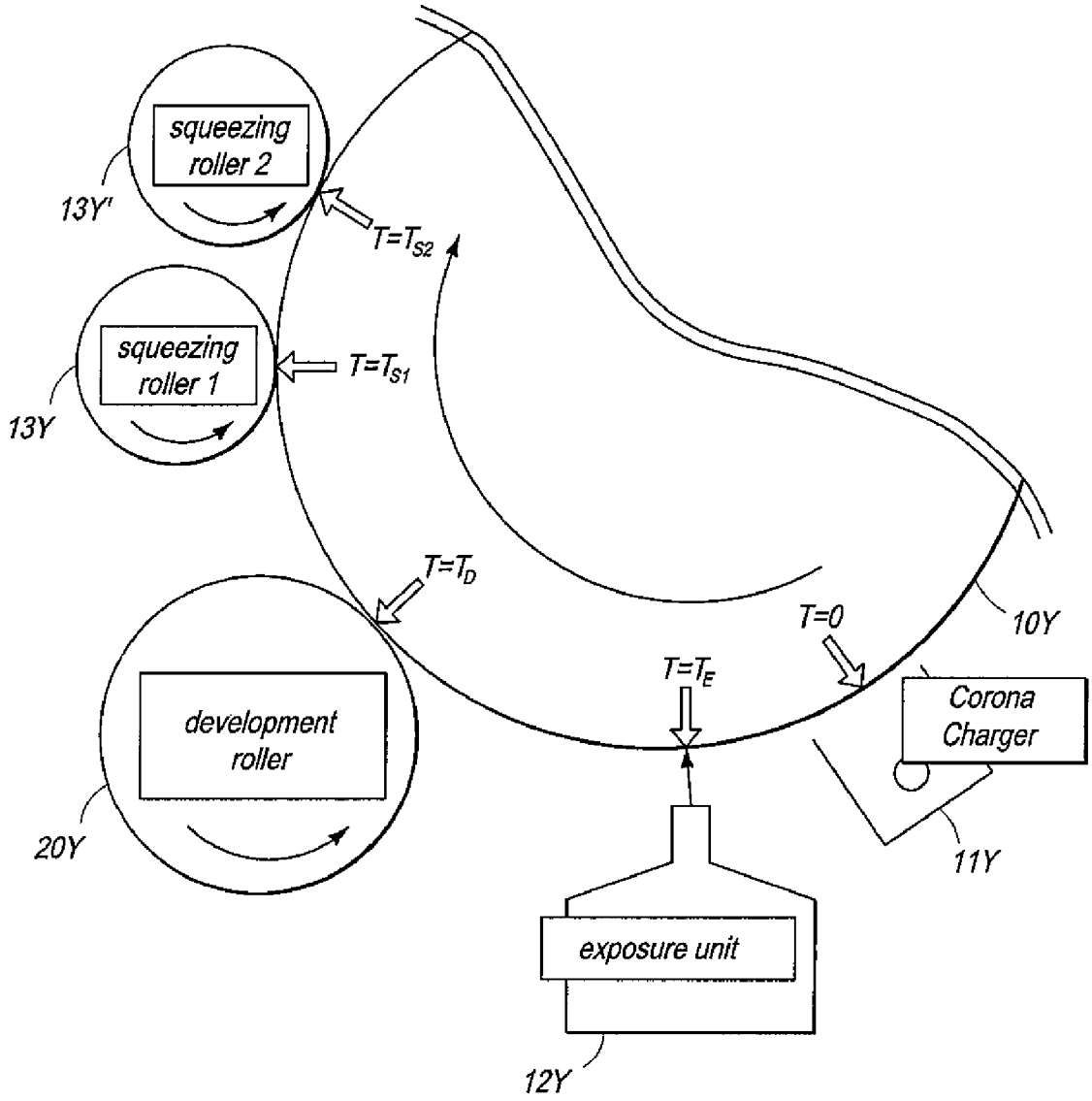
FIG. 4 is a schematic illustration of principal components of the image forming section of the image forming apparatus.
Figure 5:
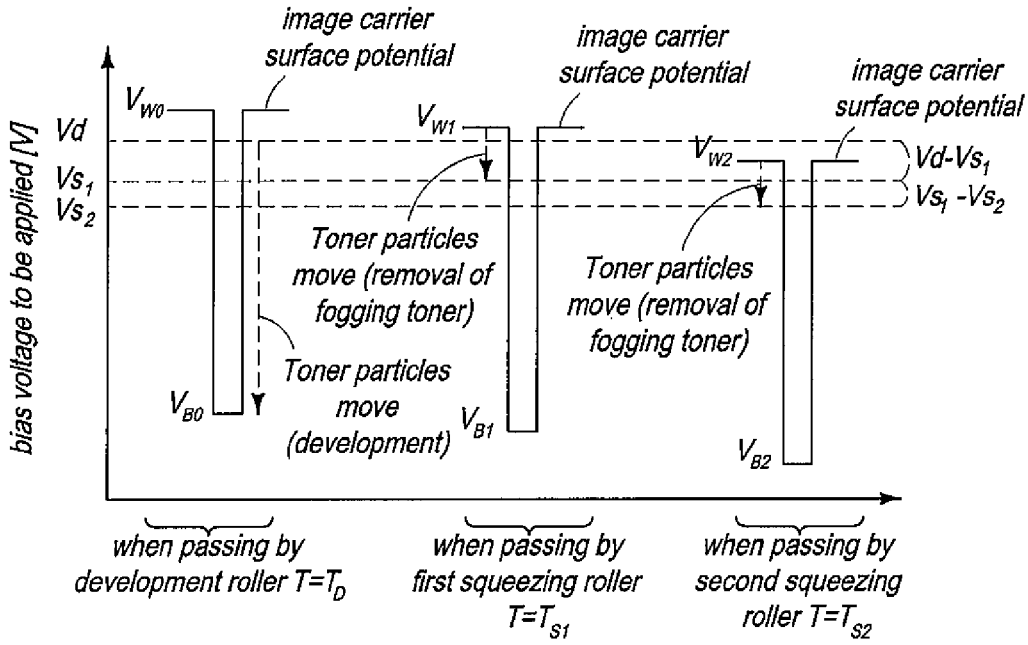
FIG. 5 is a schematic illustration of transition of the electric potential of the surface of the image carrier in an image forming process.

FIG. 4 is a schematic illustration of principal components of the yellow image forming section of the image forming apparatus and FIG. 5 is a schematic illustration of transition of the electric potential of the surface of the image carrier of the image forming apparatus in an image forming process. In FIG. 5, the vertical axis indicates the bias voltages applied to the related members.

The surface potential of the image carrier 10Y decays with time from the time of T=0 when the image carrier 10Y is electrically charged by the corona charger 11Y due to the dark decay characteristic as described above. The bias voltage of the first image carrier squeezing roller 13Y and that of the second image carrier squeezing roller 13Y' are selected by taking the dark decay characteristic of the image carrier 10Y into consideration.

The surface of the image carrier 10Y that is electrically charged by the corona charger 11Y at time T=0 is exposed to light by the exposure unit 12Y at time $T=T_E$ to form an electrostatic latent image and a developed image is formed on the surface of the image carrier 10Y as the electrostatic latent image is developed by the development roller 20Y at time $T=T_D$. Then, the first squeezing operation is performed by the first squeezing roller 13Y at time $T=T_{S1}$ to collect surplus carrier and fogging toner and the second squeezing operation is performed by the second squeezing roller 13Y' at time $T=T_{S2}$ to collect surplus carrier and fogging toner once again.

The surface potential of the image carrier shown at the left in FIG. 5 is the surface potential of the image carrier at time $T=T_D$ when the image carrier passes by the development roller 20Y. $V_{W0}$ represents the electric potential of the part of the surface of the image carrier 10Y that is not exposed to light, whereas $V_{B0}$ represents the electric potential of the part of the surface of the image carrier 10Y that is exposed to light. Vd represents the bias voltage applied to the development roller 20Y. Toner particles are positively charged and driven to move as they are attracted by the electric potential $V_{B0}$ at time $T=T_D$ when the image carrier 10Y passes by the development roller 20Y. The electrostatic latent image formed on the image carrier 10Y is developed by the toner particles that are driven to move to produce a developed image.

Fogging toner refers to toner that has moved to areas showing electric potential of $V_{W0}$ that are areas to which toner particles are not supposed to move, or areas of the unexposed part of the surface of the image carrier 10Y in the development operation. In this embodiment, such fogging toner is efficiently collected by selecting appropriate bias voltages for the first image carrier squeezing roller 13Y and the second image carrier squeezing roller 13Y'.

The surface potential of the image carrier shown at the center in FIG. 5 is the surface potential of the image carrier at time $T=T_{S1}$ when the image carrier passes by the first image carrier squeezing roller 13Y. The surface potential of the image carrier shown at the center in FIG. 5 is lower than the surface potential of the image carrier shown at the left in FIG. 5 (and observed when the image carrier passes by the development roller 20Y) as a whole. This is due to the above-described dark decay. At the center in FIG. 5, $V_{W1}$ represents the electric potential of the part of the surface of the image carrier 10Y that is not exposed to light, whereas $V_{B1}$ represents the electric potential of the part of the surface of the image carrier 10Y that is exposed to light.

In this embodiment, the bias voltage $Vs_1$ that is applied to the first image carrier squeezing roller 13Y is so selected as to satisfy the requirement of $Vd>Vs_1$. This is to drive the fogging toner existing in the unexposed part $V_{W1}$ to move toward the side of the first image carrier squeezing roller 13Y as indicated by a dotted arrow in FIG. 5. In this embodiment, the unnecessary fogging toner can be efficiently removed by selecting the bias voltage to be applied to the first image carrier squeezing roller 13Y so as to satisfy the requirement of $Vd>Vs_1$, taking the dark decay characteristic into consideration.

The surface potential of the image carrier shown at the right in FIG. 5 is the surface potential of the image carrier at time $T=T_{S2}$ when the image carrier passes by the second image carrier squeezing roller 13Y'. The surface potential of the image carrier shown at the right in FIG. 5 is lower than the surface potential of the image carrier shown at the center in FIG. 5 (and observed when the image carrier passes by the first image carrier squeezing 13Y) as a whole. This is also due to the above-described dark decay characteristic. At the right in FIG. 5, $V_{W2}$ represents the electric potential of the part of the surface of the image carrier 10Y that is not exposed to light, whereas $V_{B2}$ represents the electric potential of the part of the surface of the image carrier 10Y that is exposed to light.

In this embodiment, the bias voltage $Vs_2$ that is applied to the second image carrier squeezing roller 13Y' is so selected as to satisfy the requirement of $Vd>Vs_1>Vs_2$. This is to drive the fogging toner existing in the unexposed part $V_{W2}$ to move toward the side of the second image carrier squeezing roller 13Y' as indicated by a dotted arrow in FIG. 5. In this embodiment, the unnecessary fogging toner can be efficiently removed by selecting the bias voltage to be applied to the second image carrier squeezing roller 13Y' so as to satisfy the requirement of $Vd>Vs_1>Vs_2$, taking the dark decay characteristic into consideration.

The dark decay characteristic is such that attenuation rate is remarkable in the initial stages and becomes less remarkable as time passes as pointed out above. Taking such a tendency into consideration, fogging toner can be collected efficiently when the requirement of $Vd-Vs_1>Vs_1-Vs_2$ is satisfied. Since the positiveness or the negativeness of the bias voltages relies on the characteristics of the toner to be employed, the bias voltages are preferably generally so selected as to satisfy the requirement of $|Vd-Vs_1|>|Vs_1-Vs_2|$.

While two squeezing rollers including the first image carrier squeezing roller 13Y and the second image carrier squeezing roller 13Y' are employed in this embodiment, let us consider a generalized instance where n squeezing rollers are employed. More specifically, assume that a total of n image carrier squeezing rollers are arranged at the downstream side of the development roller 20Y and at the upstream side of the primary transfer position. When the bias voltage applied to the image carrier squeezing roller arranged immediately downstream relative to the development roller 20Y is $Vs_1$, the bias voltage applied to the image carrier squeezing roller arranged immediately downstream relative to the image carrier squeezing roller to which the bias voltage of $Vs_1$ is applied is $Vs_2 \ldots$, the bias voltage applied to the image carrier squeezing roller arranged immediately downstream relative to the image carrier squeezing roller to which the bias voltage of $Vs_{n-2}$ is applied is $Vs_{n-1}$ and the bias voltage applied to the image carrier squeezing roller arranged immediately downstream relative to the image carrier squeezing roller to which the bias voltage of $Vs_{n-1}$, is applied is $Vs_n$, it is sufficient for the bias voltages to show a relationship that satisfies the requirement of $Vs_1>Vs_2>\ldots>Vs_{n-1}>Vs_n$. With this arrangement, fogging toner can be removed efficiently by all the image carrier squeezing rollers as the decay of the surface potential of the image carrier due to the dark decay characteristic thereof is taken into consideration.

Meanwhile, there are known image forming apparatus adapted to shift the speed of progress of the image forming process (or the rotational speed of the image carriers) depending on the type of the recording medium onto which an image is to be formed and which may be relatively thick ordinary paper or thin high-quality paper. When the concept of this embodiment is applied to such an image forming adapted to change the speed of progress of the image forming process (the rotational speed of the image carriers), the times it takes for the image carrier 10Y to move from the position where it is electrically charged by the corona charger 11Y to the first image carrier squeezing roller 13Y and then to the second image carrier squeezing roller 13Y' vary as a function of the rotational speed of the image carrier 10Y. In other words, the bias voltage $Vs_1$ and the bias voltage $Vs_2$ need to be modified according to the rotational speed of the image carrier 10Y. Then, as a result, fogging toner can be effectively removed by means of optimum bias voltages that are modified according to the printing speed (which is proportional to the rotational speed of the image carrier) that varies as a function of the recording medium.

When modifying the bias voltages $Vs_1$ and $Vs_2$ according to the rotational speed of the image carrier 10Y as described above, the quantity by which the bias voltage $Vs_1$ is modified is made greater than quantity by which the bias voltage $Vs_2$ is modified. This is because the dark decay characteristic is such that attenuation rate is remarkable in the initial stages and becomes less remarkable as time passes as pointed out above. In other words, when shifting the printing speed (which is proportional to the rotational speed of the image carrier), the electric potential of the first image carrier squeezing roller 13Y is modified to a larger extent than the electric potential of the second image carrier squeezing roller 13Y' because the quantity by which the electric potential decays is greater at the preceding squeezing roller than at the succeeding squeezing roller. Fogging toner can be effectively removed by selecting the bias voltages in the above-described manner.

Figure 6:
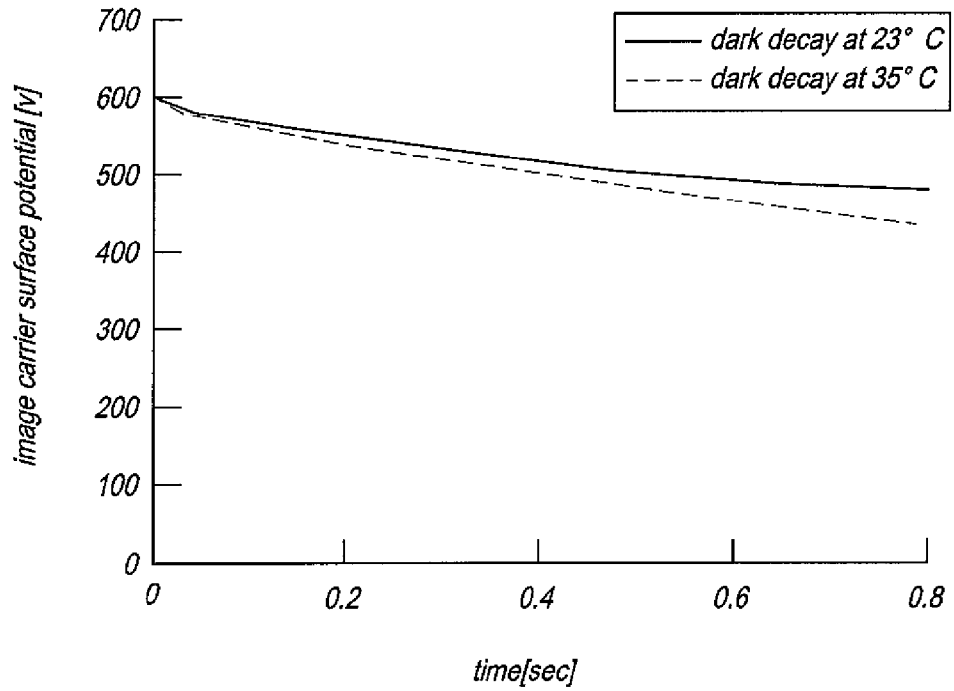
FIG. 6 is a schematic illustration of the change in the dark decay characteristic of the image carrier that is produced by a temperature change.

Now, the dark decay characteristic changes with temperature and selection of the bias voltages of the image carrier squeezing rollers that is made by taking such a change into consideration will be described below. FIG. 6 is a schematic illustration of the change in the dark decay characteristic of the image carrier 10Y that is produced by a temperature change. FIG. 6 shows the change with time of the surface potential after the image carrier 10Y is electrically charged to 600V in a dark places with different temperatures. As seen from FIG. 6, the attenuation rate of electric potential of the image carrier 10Y that is an amorphous silicon photoconductor due to the dark decay is remarkable when the temperature is high.

The change in the dark decay characteristic due to a temperature change as shown in FIG. 6 is taken into consideration when selecting the bias voltages of the image carrier squeezing rollers. For the purpose of simplicity, let us consider a system where a single image carrier squeezing roller, or only the first image carrier squeezing roller 13Y, is provided.

Figure 7:
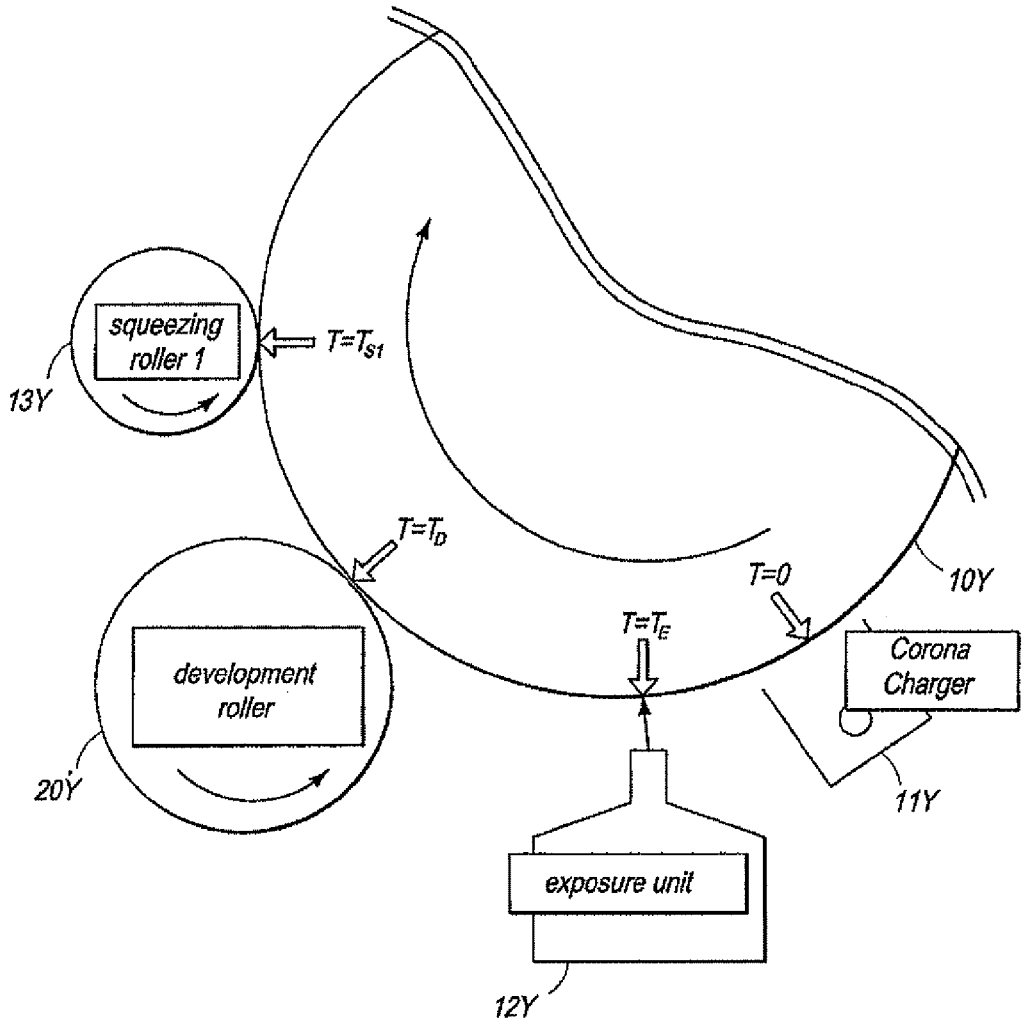
FIG. 7 Prior Art
FIG. 7 is a schematic illustration of principal components of an image forming apparatus having a single image carrier squeezing roller.
Figure 8:
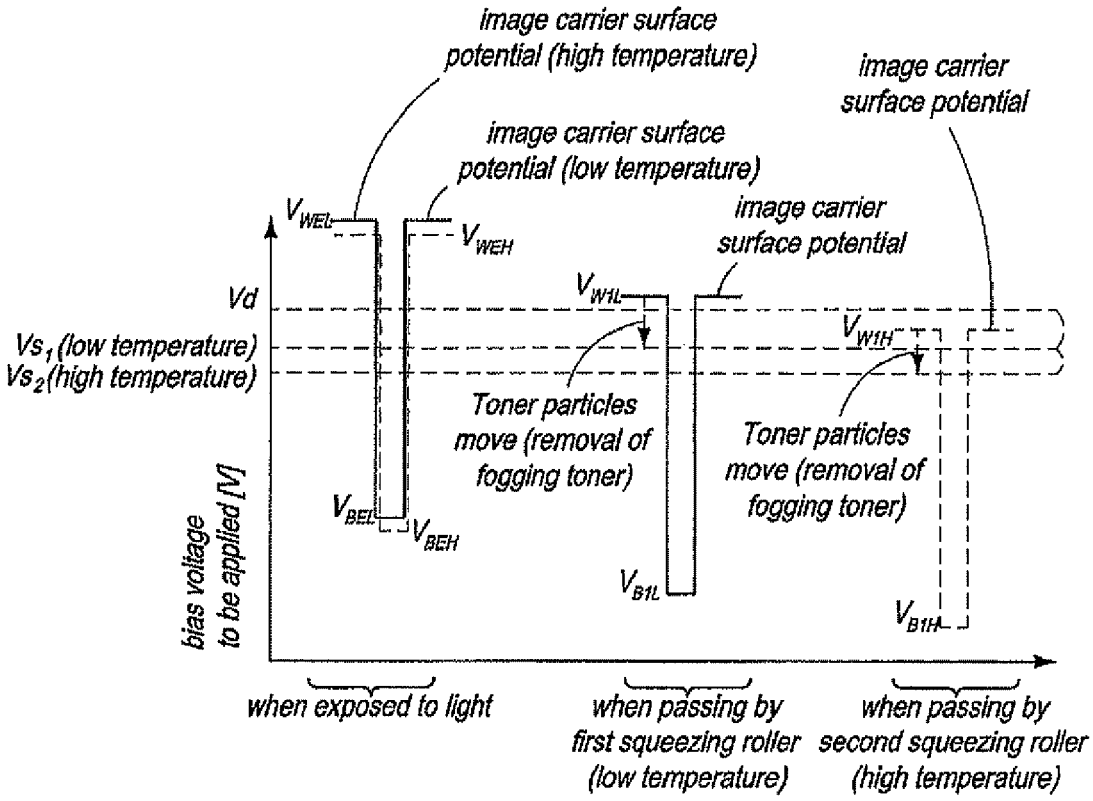
FIG. 8 Prior Art
FIG. 8 is a schematic illustration of transition of the electric potential of the surface of the image carrier of the image forming apparatus of FIG. 7 due to a temperature change in an image forming process.

FIG. 7 is a schematic illustration of principal components of an image forming apparatus having a single image carrier squeezing roller. FIG. 8 is a schematic illustration of transition of the electric potential of the surface of the image carrier of the image forming apparatus of FIG. 7 due to a temperature change in an image forming process. In FIG. 8, the vertical axis indicates the bias voltages respectively applied to the corresponding members.

The electric potential of the surface of the image carrier shown at the left side in FIG. 8 is the surface potential of the image carrier at time $T=T_E$ when the image carrier passes by the exposure nit 12Y. The solid lines at the left side show the surface potential of the image carrier that is observed when the temperature is low. More specifically, $V_{WEL}$ represents the electric potential of the unexposed part of the surface of the image carrier 10Y, whereas $V_{BEL}$ represents the electric potential of the exposed part of the surface of the image carrier 10Y. The dotted lines at the left side show the surface potential of the image carrier that is observed when the temperature is higher. More specifically, $V_{WEH}$ represents the electric potential of the unexposed part of the surface of the image carrier 10Y, whereas $V_{BEH}$ represents the electric potential of the exposed part of the surface of the image carrier 10Y.

Note that Vd represents the bias voltage that is applied to the development roller 20Y.

The electric potential of the surface of the image carrier shown at the center in FIG. 8 is the surface potential of the image carrier that is observed when the temperature is low and also the surface potential of the image carrier that is observed at time $T=T_{S1}$ when the image carrier passes by the first image carrier squeezing roller 13Y. The surface potential of the image carrier shown at the center of FIG. 8 is lower as a whole than the surface potential of the image carrier shown at the left side of FIG. 8 (when the temperature is low). This is due to the above-described dark decay. At the center in FIG. 8, $V_{W1L}$ represents the electric potential of the part of the surface of the image carrier 10Y that is not exposed to light, whereas $V_{B1L}$ represents the electric potential of the part of the surface of the image carrier 10Y that is exposed to light.

The electric potential of the surface of the image carrier shown at the right side in FIG. 8 is the surface potential of the image carrier that is observed when the temperature is higher than the temperature shown at the center of FIG. 8 and also the surface potential of the image carrier that is observed at time $T=T_{S1}$ when the image carrier passes by the first image carrier squeezing roller 13Y. The surface potential of the image carrier shown at the right side of FIG. 8 is lower as a whole than the surface potential of the image carrier shown at the left side of FIG. 8 (when the temperature is high). This is due to the above-described dark decay characteristic. At the right side in FIG. 8, $V_{W2}$ represents the electric potential of the part of the surface of the image carrier 10Y that is not exposed to light, whereas $V_{B2}$ represents the electric potential of the part of the surface of the image carrier 10Y that is exposed to light.

The surface potential of the image carrier shown at the right side of FIG. 8 (when the temperature is high) is lower than the surface potential of the image carrier shown at the center of FIG. 8 (when the temperature is low) as a whole due to the temperature characteristic of dark decay.

In this embodiment, a temperature detection means (not shown) is provided to detect the temperature, taking the above-described temperature characteristic of dark decay into consideration so that the bias voltage to be applied to the image carrier squeezing roller is modified according to the temperature detected by the temperature detection means. This principle is also applicable to the image forming apparatus having two image carrier squeezing rollers including the first image carrier squeezing roller 13Y and the second image carrier squeezing roller 13Y'. The electric conductivity characteristic of amorphous silicon photoconductor changes with temperature and the electric potential attenuates more quickly at the high temperature side. Therefore, the bias voltage is lowered when the temperature is high to accommodate such a change to appropriately remove fogging toner.

When the bias voltages $Vs_1$ and $Vs_2$ are modified according to the temperature detected by the temperature detection means, the quantity of the change in the bias voltage $Vs_1$ is made greater than the quantity of the change in the bias voltage $Vs_2$. Since the electric potential is attenuated more remarkably by temperature at the second image carrier squeezing roller 13Y' than at the first image carrier squeezing roller 13Y, fogging toner can be effectively removed by modifying the electric potential of the second image carrier squeezing roller 13Y' more than the electric potential of the first image carrier squeezing roller 13Y.

Now, the present invention will be described further by way of examples.

EXAMPLE 1

The image carrier 10 that is an amorphous silicon photoconductor is electrically charged by the corona charger 11 to a predetermined surface potential. At this time, the potential of the electric charge of the image carrier 10 is about 500 to 600 V. Subsequently, light is irradiated to the image section (black section) from the exposure unit 12 and the surface potential of the image section (black section) that is produced as the image carrier 10 is electrically charged by the corona charger is offset so as to fall to about 50 to 100 V. On the other hand, no light is irradiated to the non-image section (white section). However, the surface potential naturally attenuates if not exposed to light. It is described above that this is a phenomenon referred to as dark decay.

From the above, it will be seen that if the image carrier 10 is electrically charged to show an electric potential of 600 V, the electric potential falls as the image carrier 10 gets to the development position of the development roller 20 and the squeezing positions of the first image carrier squeezing roller 13Y and the second image carrier squeezing roller 13Y'. The electric potential falls remarkably immediately after the end of the operation of electrically charging the image carrier 10 and the rate at which the electric potential attenuates falls gradually thereafter.

To remove fogging toner from the first image carrier squeezing roller 13Y and the second image carrier squeezing roller 13Y' without agglomerating toner, it is desirable to make their electric potentials lower than the surface potential of the image carrier 10 by 50 to 100 V. If the electric potentials of the squeezing rollers are made lower to show greater voltage differences, toner agglomerates when the image carrier is squeezed to give rise to defective cleaning and difficulty of recycling. If, on the other hand, the electric potentials of the squeezing rollers are made higher to show smaller voltage differences, it is no longer possible to effectively remove fogging toner by squeezing the image carrier and the white part of the printed product will be smeared.

In view of the above fact, an experiment as described below is conducted with a layout of a corona charger 11Y, an exposure unit 12Y, a development roller 20Y, a first image carrier squeezing roller 13Y and a second image carrier squeezing roller 13Y' as shown in FIG. 4. The image carrier 10Y has a diameter of 78 mm and the squeezing bias conditions are modified because the times it takes for the image carrier takes to get to the development position and then to the squeezing positions vary as the rotational speed of the image carrier 10Y is modified. The dark decay also changes as a function of temperature and humidity. Therefore, the effect is observed by modifying the squeezing bias conditions.

An image carrier (photoconductor) 10Y having ø78 is driven at a rotational speed of 210 mm/sec and electrically charged to show a potential of 600 V. In order to remove fogging on the photoreceptor, since toner is electrically positively charged, the squeeze bias voltage of the first image carrier squeezing roller 13Y and that of the second image carrier squeezing roller 13Y' need to be made lower than the surface potential of the image carrier. Thus, the values as listed in Table 1 are selected so as to make the bias voltage $Vs_2$ lower than the bias voltage $V_{s1}$ and also make $(Vs_1-Vs_2)$ smaller than $(Vd-Vs_1)$ in order to accommodate the dark decay of the image carrier 10Y. As a result, toner does not agglomerate and fogging toner can be effectively removed.

TABLE 1

| | Example 1 | Example 2 | Example 3 | Example 4 |
|---|---|---|---|---|
| environment (temperature, humidity) | 23° C., 55% | 23° C., 55% | 35° C., 65% | 23° C., 55% |
| rotational speed of image carrier (outermost periphery) | 210 mm/sec | 270 mm/sec | 150 mm/sec | 210 mm/sec |
| development roller bias voltage | 480 V | 500 V | 470 V | 550 V |
| bias voltage $Vs_1$ | 440 V | 470 V | 420 V | 500 V |
| bias voltage $Vs_2$ | 410 V | 450 V | 380 V | 460 V |
| bias voltage $Vs_3$ | — | — | — | 430 V |

EXAMPLE 2

An image carrier (photoconductor) 10Y also having ø78 is driven to rotate at a rotational speed of 270 mm/sec and electrically charged to show a potential of 600V. The values as listed in Table 1 are selected so as to make the bias voltage $Vs_2$ lower than the bias voltage $Vs_1$ and also make $(Vs_1-Vs_2)$ smaller than $(Vd-Vs_1)$ in order to accommodate the dark decay of the image carrier 10Y. As a result, toner does not agglomerate and fogging toner can be effectively removed.

EXAMPLE 3

An image carrier (photoconductor) 10Y also having ø78 is driven to rotate at a rotational speed of 150 mm/sec and electrically charged to show a potential of 600 V. The values as listed in Table 1 are selected so as to make the bias voltage $Vs_2$ lower than the bias voltage $Vs_1$ and also make $(Vs_1-Vs_2)$ smaller than $(Vd-Vs_1)$ in order to accommodate the dark decay of the image carrier 10Y. As a result, toner does not agglomerate and fogging toner can be effectively removed.

EXAMPLE 4

Figure 9:
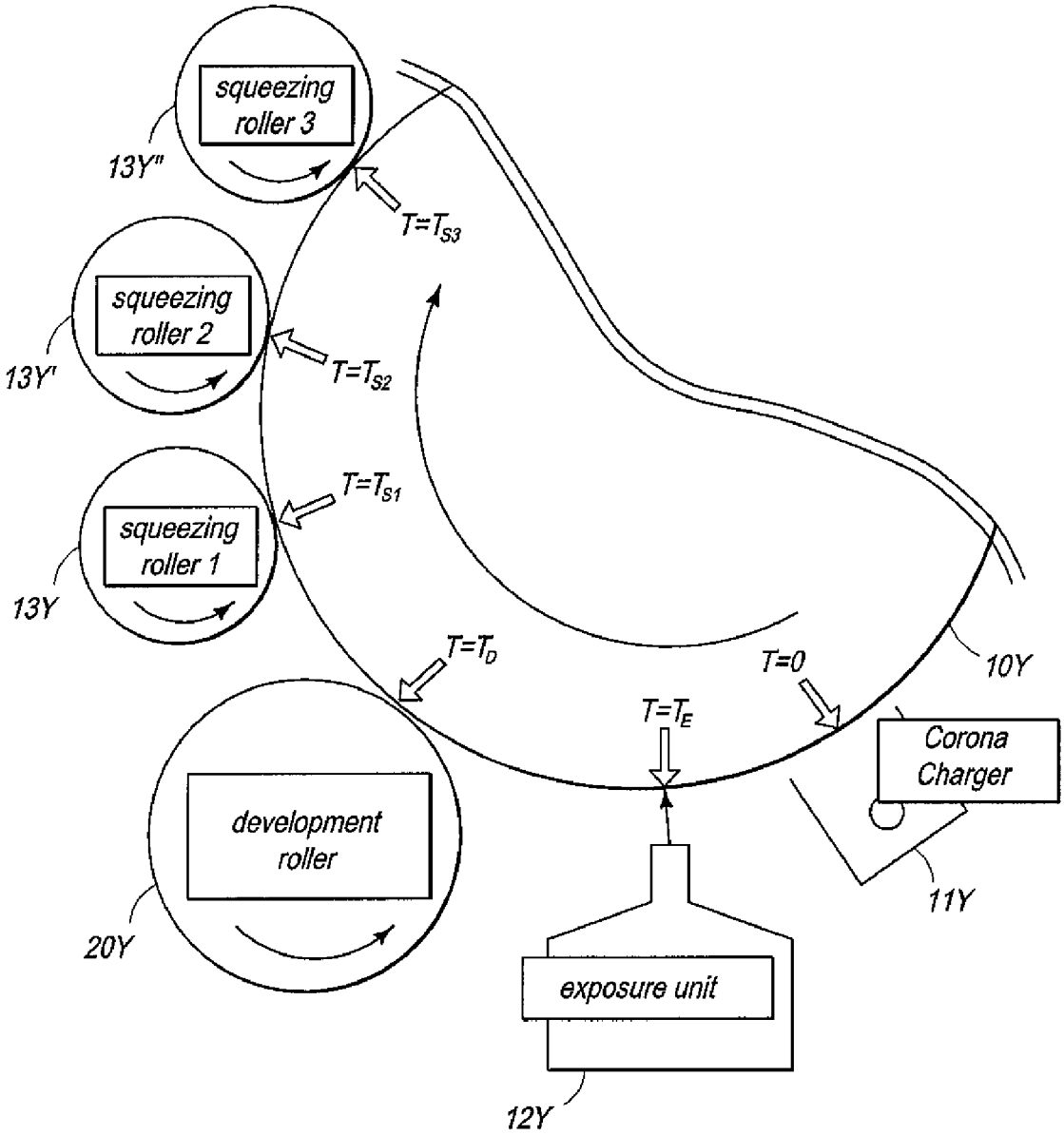
FIG. 9 is a schematic illustration of principal components of an image forming apparatus having three image carrier squeezing rollers.

An image carrier (photoconductor) 10Y also having ø78 is driven to rotate at a rotational speed of 210 mm/sec and electrically charged to show a potential of 600 V. The values as listed in Table 1 are selected so as to make the bias voltage $Vs_2$ lower than the bias voltage $Vs_1$ and the bias voltage $Vs_3$ lower than the bias voltage $Vs_2$ and also make $(Vs_1-Vs_2)$ smaller than $(Vd-Vs_1)$ and $(Vs_2-Vs_3)$ smaller than $(Vs_1-Vs_2)$ in order to accommodate the dark decay of the image carrier 10Y. As a result, toner does not agglomerate and fogging toner can be effectively removed. FIG. 9 is a schematic illustration of principal components of the image forming apparatus of Example 4.

Thus, an image forming apparatus and a method of controlling an image forming apparatus according to the present invention can efficiently remove unnecessary fogging toner by means of the squeezing rollers adapted to show appropriately selected bias voltages.

Additionally, an image forming apparatus and a method of controlling an image forming apparatus according to the present invention can remove fogging toner in accordance with the rate at which the electric potential of each of the image carriers attenuates.

Still additionally, an image forming apparatus and a method of controlling an image forming apparatus according to the present invention can appropriately remove fogging toners by lowering the bias voltages of the squeezing rollers when the temperature is high, taking the fact that the electric potential attenuates more quickly at the high temperature side due to the change with temperature in the electric conductivity characteristic of amorphous silicon photoconductor.

Still additionally, an image forming apparatus and a method of controlling an image forming apparatus according to the present invention can effectively remove fogging toner by modifying the electric potential of the second squeezing roller to a greater extent than the electric potential of the first squeezing roller because the electric potential of the second squeezing roller attenuates more remarkably as a function of temperature.

Still additionally, an image forming apparatus and a method of controlling an image forming apparatus according to the present invention can effectively remove fogging toner by means of optimum bias voltages that are selected to correspond to the printing speed (which is proportional to the rotational speed of the image carriers) that varies as a function of the type of recording medium.

Furthermore, an image forming apparatus and a method of controlling an image forming apparatus according to the present invention can effectively remove fogging toner by modifying the electric potential of the first squeezing roller to a greater extent than the electric potential of the second squeezing roller because the electric potential attenuate more remarkably at the upstream squeezing roller when the printing speed (which is proportional to the rotational speed of the image carriers) is varied.

Figure 10:
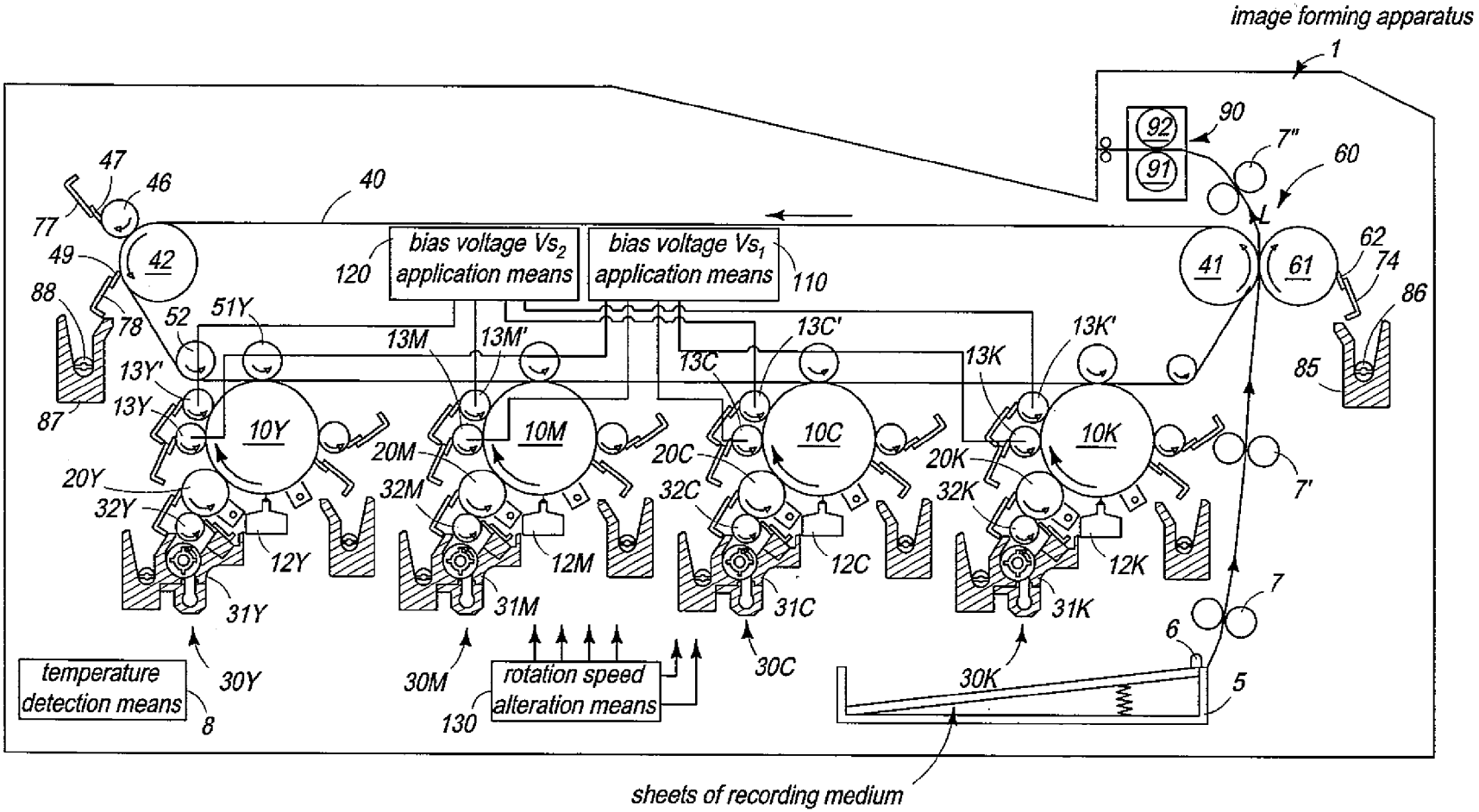
FIG. 10 is a schematic illustration of an image forming apparatus according to another embodiment of the present invention, showing principal components thereof.

Now, another embodiment of the present invention will be described below. FIG. 10 is a schematic illustration of an image forming apparatus according to the another embodiment of the present invention, showing principal components thereof. The embodiment is so designed as to accommodate a situation where the photosensitive surface layers of the image carriers 10Y, 10M, 10C and 10K are organic photoconductors (OPCs) in addition to a situation where they are amorphous silicon photoconductors. In FIG. 10, the components similar to those of the preceding embodiment are denoted respectively by the same reference symbols and will not be described any further. Note that this embodiment is designed to accommodate both a situation where the image carriers are amorphous silicon photoconductors and a situation where they are organic photoconductors.

In the image forming apparatus 1 of this embodiment, sheets of recording medium set in position in a sheet feeding cassette 5 are fed out one by one at predetermined timings to sheet conveyance route L by means of a pickup roller 6. Then, each sheet of recording medium is conveyed to the secondary transfer position by means of conveyance roller pair 7, 7' along the sheet conveyance route L and the monochromatic toner image or the full color toner image formed on the intermediate transfer body 40 is transferred onto a sheet of recording medium. The sheet of recording medium that is now bearing the image transferred onto it by secondary transfer is then conveyed to a fixing unit 90 by means of conveyance roller pair 7". The fixing unit 90 is formed by using a heating roller 91 and a pressurizing roller 92 urged toward the heating roller 91 under pressure of a certain level. The sheet of recording medium is then driven into the nip section of the heating roller 91 and the pressurizing roller 92 and the monochromatic toner image or the full color toner image that is transferred onto the sheet is fusion-boded to and fixed on the sheet.

A bias voltage $Vs_1$ application means 110 applies bias voltage $Vs_1$ of a predetermined level to the first image carrier squeezing roller 13Y at a predetermined timing to collect unnecessary fogging toner on the image carrier. Similarly, a bias voltage $Vs_2$ application means 120 applies bias voltage $Vs_2$ of a predetermined level to the second image carrier squeezing roller 13Y at a predetermined timing to collect unnecessary fogging toner on the image carrier.

The image forming apparatus 1 shifts the speed of progress of the image forming process (or the rotational speed of the image carriers) depending on the type of the recording medium onto which an image is to be formed and which may be relatively thick ordinary paper or thin high-quality paper. A rotational speed alteration means 130 is the means responsible for shifting the speed. The rotational speed alteration means 130 has a function of comprehensively modifying various speeds including the rotational speed of the intermediate transfer body, the conveyance speed at the sheet conveyance route and the rotational speed of the development devices of the different colors. Note that the bias voltage $Vs_1$ application means 110, the bias voltage $Vs_2$ application means 120, the rotational speed alteration means 130 and other means are controlled by a CPU (not shown) in a coordinated manner.

Figure 11:
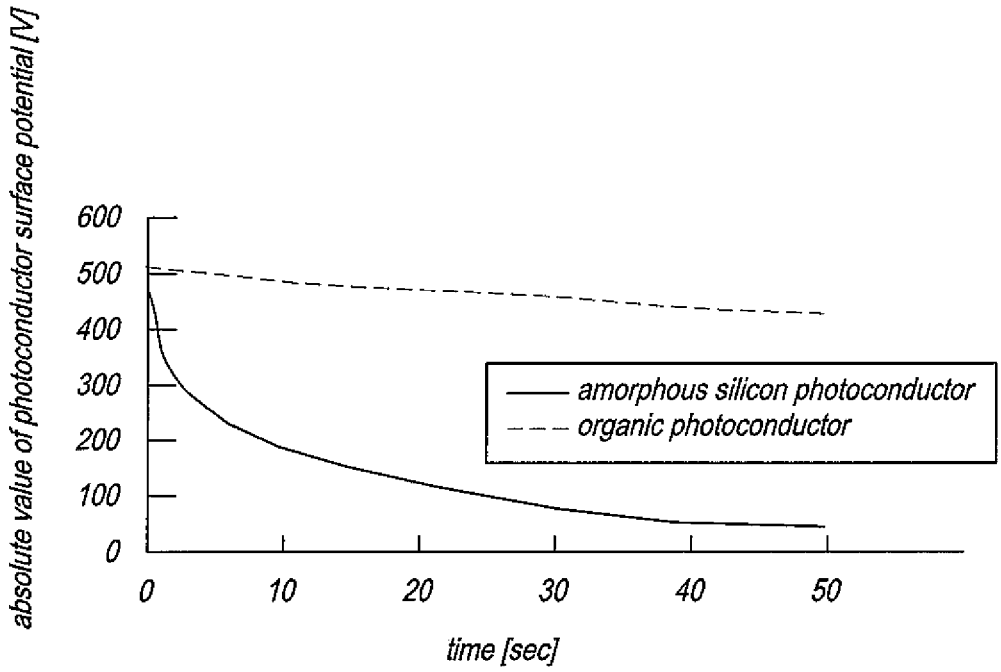
FIG. 11 is a graph illustrating the dark decay characteristic of amorphous silicon photoconductor and that of organic photoconductor.

Now, the characteristics of amorphous silicon photoconductor and those of organic photoreceptor that may be employed for the image carriers of the image forming apparatus 1 of this embodiment will be described below. FIG. 11 is a graph illustrating the dark decay characteristic of amorphous silicon photoconductor and that of organic photoconductor, showing the difference between them. As illustrated, an amorphous silicon photoconductor shows a higher rate of attenuation than an organic photoconductor. Since the organic photoconductor is a photosensitive material that is negatively charged, its dark decay characteristic shows a fall from −500 V to 0V. However, the organic photoconductor can be compared with the amorphous silicon photoconductor as the absolute values of electric potentials are used in the drawing.

The amorphous silicon photoconductor employed for the image carriers of the preceding embodiment is a photosensitive material that is positively charged, and the organic photoconductor employed for the image carriers of this embodiment is a photosensitive material that is negatively charged. However, the concept of the present invention is applicable to materials that are negatively charged.

Figure 12:
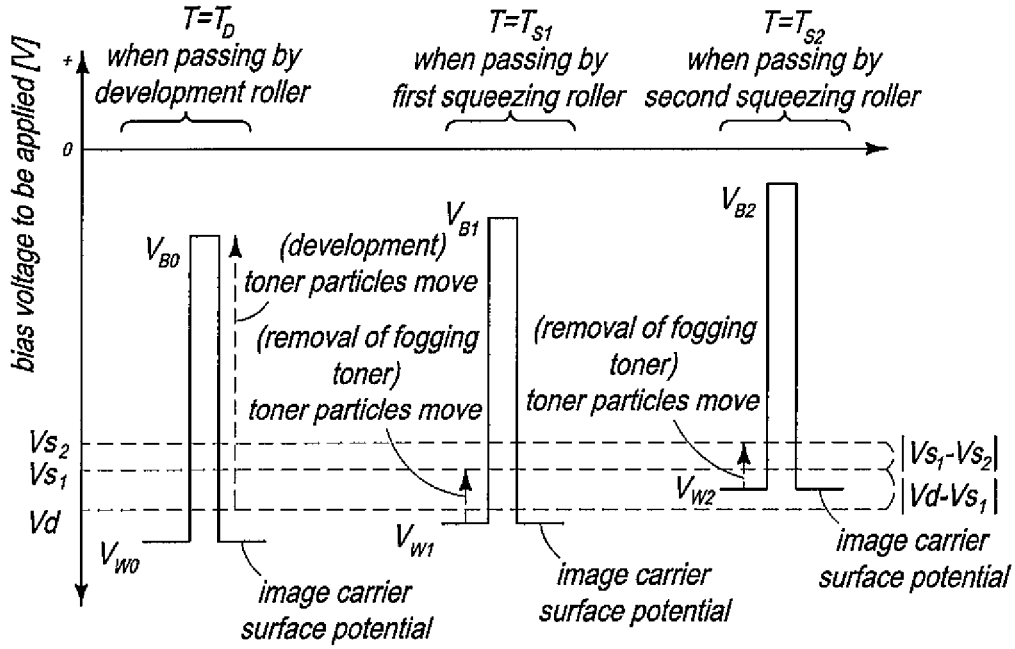
FIG. 12 is a schematic illustration of transition of the electric potential of the surface of a negatively-charged image carrier of an image forming apparatus according to the present invention in an image forming process.

This will be described below by referring to FIG. 12. FIG. 12 is a schematic illustration of transition of the electric potential of the surface of a negatively-charged image carrier of an image forming apparatus according to the present invention in an image forming process. Since FIG. 12 is similar to FIG. 5 and can be read in a similar manner, it will not be described any further in terms of how it is supposed to be read. Note that each of $Vs_1$, $Vs_2$ and Vd takes a negative value in FIG. 12.

Fogging toner can be efficiently collected by selecting appropriate bias voltages respectively for the first image carrier squeezing roller 13Y and the second image carrier squeezing roller 13Y' when the image carrier is an organic photoconductor.

The surface potential of the image carrier shown at the center of FIG. 12 is the surface potential of the image carrier when it passes by the first image carrier squeezing roller 13Y at time $T=T_{S1}$. The surface potential of the image carrier shown at the center of FIG. 5 is higher than the surface potential of the image carrier shown at the left side (when it passes by the development roller 20Y) as a whole. This is due to the above-described dark decay. At the center in FIG. 5, $V_{W1}$ represents the electric potential of the part of the surface of the image carrier 10Y that is not exposed to light, whereas $V_{B1}$ represents the electric potential of the part of the surface of the image carrier 10Y that is exposed to light.

In this embodiment that employs image carriers that are negatively charged, the bias voltage $Vs_1$ to be applied to the first image carrier squeezing roller 13Y is so selected as to satisfy the requirement of $Vs_1>Vd$. This is to drive the fogging toner existing in the unexposed part $V_{W1}$ to move toward the side of the first image carrier squeezing roller 13Y as indicated by an arrow of dotted line. In this embodiment, unnecessary fogging toner can be efficiently removed by selecting the bias voltage to be applied to the first image carrier squeezing roller 13Y so as to satisfy the requirement of $Vs_1>Vd$, taking the dark decay characteristic into consideration.

The surface potential of the image carrier shown at the right side of FIG. 12 is the surface potential of the image carrier at time $T=Ts_2$ when it passes by the second image carrier squeezing roller 13Y'. The surface potential of the image carrier shown at the right side of FIG. 12 is higher than the surface potential of the image carrier (when it passes by the first image carrier squeezing roller 13Y) shown at the center of FIG. 12 as a whole. This is due to the above-described dark decay characteristic. At the right side in FIG. 12, $V_{W2}$ represents the electric potential of the part of the surface of the image carrier 10Y that is not exposed to light, whereas $V_{B2}$ represents the electric potential of the part of the surface of the image carrier 10Y that is exposed to light.

When an organic photoconductor is employed for the image carrier, the bias voltage $Vs_2$ to be applied to the second image carrier squeezing roller 13Y' is so selected as to satisfy the requirement of $Vs_2>Vs_1>Vd$. This is to drive the fogging toner existing in the unexposed part $V_{W2}$ to move toward the side of the second image carrier squeezing roller 13Y' as indicated by an arrow of dotted line. In this embodiment, unnecessary fogging toner can be efficiently removed by selecting the bias voltages to be applied to the first image carrier squeezing roller 13Y and the second image carrier squeezing roller 13Y' respectively by the bias voltage $Vs_1$ application means 110 and the bias voltage $Vs_2$ application means 120 so as to satisfy the requirement of $Vs_2>Vs_1>Vd$, taking the dark decay characteristic of the negatively-charged photosensitive material into consideration. Taking situations where amorphous silicon photoconductors that are positively charged are employed into consideration, the bias voltages are preferably so selected as to satisfy the requirement of $|Vd|>|Vs_1|>|Vs_2|$. With such an arrangement, fogging toner can be removed according to the rate of attenuation of the electric potential of the image carrier.

The dark decay characteristic is such that attenuation rate is remarkable in the initial stages and becomes less remarkable as time passes as pointed out above. Taking such a tendency into consideration, fogging toner can be collected more efficiently when the bias voltages to be applied by the bias voltage $Vs_1$ application means 110 and the bias voltage $Vs_2$ application means 120 are so selected as to satisfy the requirement of $|Vd-Vs_1|>|Vs_1-Vs_2|$. Taking situations where amorphous silicon photoconductors that are positively charged are employed into consideration, the bias voltages are preferably generally so selected as to satisfy the requirement of $||Vd|-|Vs_1||>||Vs_1|-|Vs_2||$. With such an arrangement, fogging toner can be removed according to the rate of attenuation of the electric potential of the image carrier.

Now, let us consider a generalized instance where n squeezing rollers are provided. In other words, n image carrier squeezing rollers are arranged at the downstream side of the development roller 20 and at the upstream side of the primary transfer position. In such an instance, it is sufficient for the bias voltages to show a relationship that satisfies the requirement of $|Vs_1|>|Vs_2|>|Vs_3|\ldots>|Vs_{n-1}|>|Vs_n|$ regardless if an amorphous silicon photoconductor or an organic photoconductor is employed for the image carrier 10. With this arrangement, fogging toner can be removed efficiently by all the image carrier squeezing rollers as the decay of the surface potential of the image carrier due to the dark decay characteristic thereof is taken into consideration.

Now, the darkness decay characteristic changes with temperature and selection of the bias voltages of the image carrier squeezing rollers that is made by taking such a change into consideration will be described below. As pointed out earlier, the attenuation rate of electric potential of the image carrier 10 that is an amorphous silicon photoconductor is remarkable when the temperature is high. An organic photoconductor also shows such a tendency. Thus, embodiments adapted to detect the temperature change in the inside of the image forming apparatus 1 by means of a temperature detection means 9 and modify the selected bias voltages of the image carrier squeezing rollers according to the detected temperature to efficiently collect fogging toner will be described below.

Firstly, there is an embodiment adapted to modify only the bias voltage $Vs_1$ by means of a bias voltage $Vs_1$ application means 110 according to the temperature detected by a temperature detection means 9. Since such an embodiment does not need to modify the bias voltage $Vs_2$ by means of a bias voltage $Vs_2$ application means 120, the bias voltage $Vs_2$ application means 120 can be structurally made simple. Additionally, fogging toner is intensively removed by the first image carrier squeezing roller 13Y that is the first squeezing means that operates first after a developing process.

Additionally, there is an embodiment adapted to modify only the bias voltage $Vs_2$ by means of a bias voltage $Vs_2$ application means 120 according to the temperature detected by a temperature detection means 9. Since such an embodiment does not need to modify the bias voltage $Vs_1$ by means of a bias voltage $Vs_1$ application means 110, the bias voltage $Vs_1$ application means 110 can be structurally made simple. Additionally, fogging toner is intensively removed by the second image carrier squeezing roller 13Y' that is the squeezing means that operates immediately before a transferring process.

Furthermore, there is an embodiment adapted to modify both the bias voltage $Vs_1$ and the bias voltage $Vs_2$ respectively by means of a bias voltage $Vs_1$ application means 110 and a bias voltage $Vs_2$ application means 120 according to the temperature detected by a temperature detection means 9. Such an embodiment can remove fogging toner by means of the first and second squeezing rollers according to the temperature detected by the temperature detection means 9.

When modifying both the bias voltage $Vs_1$ and the bias voltage $Vs_2$ respectively by means of a bias voltage $Vs_1$ application means 110 and a bias voltage $Vs_2$ application means 120, it is preferable to make the quantity of the change in the bias voltage $Vs_1$ greater than the quantity of the change in the bias voltage $Vs_2$. Such an embodiment can effectively remove fogging toner by changing the electric potential of the first squeezing roller more remarkably than the second squeezing roller because the quantity by which the electric potential of the first squeezing roller attenuates is more remarkable than the quantity by which the electric potential of the second squeezing roller attenuates.

Meanwhile, the image forming apparatus 1 is adapted to shift the speed of progress of the image forming process (or the rotational speed of the image carriers) depending on the type of the recording medium onto which an image is to be formed and which may be relatively thick ordinary paper or thin high-quality paper. The rotational speed alteration means 130 is the control means responsible for shifting the speed of progress of the image forming process (or the rotational speed of the image carriers). The bias voltage $Vs_1$ and the bias voltage $Vs_2$ are modified respectively by means of the bias voltage $Vs_1$ application means 110 and the bias voltage $Vs_2$ application means 120 according to the rotational speed of the image carriers 10 that is shifted by the rotational speed alteration means 130. This arrangement is provided because the time periods that are spent from the time of when the image carrier 10 is electrically charged by the corona charger 11 to the time when the image carrier 10 gets to the first image carrier squeezing roller 13Y and the second image carrier squeezing roller 13Y' vary as a function of the rotational speed of the image carrier 10. Thus, with this arrangement, fogging toner can be removed effectively with optimum bias voltages that are adjusted in response to the change in the printing speed (which is proportional to the rotational speed of the image carrier) according to the type of the recording medium.

Additionally, the quantity by which the bias voltage $Vs_1$ is modified by the bias voltage $Vs_1$ application means 110 is made greater than quantity by which the bias voltage $Vs_2$ is modified by the bias voltage $Vs_2$ application means 120. This is because the dark decay characteristic is such that attenuation rate is remarkable in the initial stages and becomes less remarkable as time passes. In other words, when shifting the printing speed (which is proportional to the rotational speed of the image carrier), the electric potential of the first image carrier squeezing roller 13Y is modified to a larger extent than the electric potential of the second image carrier squeezing roller 13Y' because the quantity by which the electric potential decays is greater at the preceding squeezing roller than at the succeeding squeezing roller. Fogging toner can be effectively removed by selecting the bias voltages in the above-described manner.

The bias voltage $Vs_1$ and the bias voltage $Vs_2$ are preferably increased respectively by means of the bias voltage $Vs_1$ application means 110 and the bias voltage $Vs_2$ application means 120 according to the rotational speed of the image carriers 10 that are shifted by the rotational speed alteration means 130. With this arrangement, fogging toner can be effectively removed by means of optimum bias voltages according to the printing speed (which is proportional to the rotational speed of the image carriers) that is shifted according to the type of recording medium.

Preferably, the quantity by which the bias voltage $Vs_1$ is modified is made greater than quantity by which the bias voltage $Vs_2$ is modified. Then, fogging toner can be removed effectively by changing the electric potential of the first squeezing roller more remarkably than the second squeezing roller because the quantity by which the electric potential of the first squeezing roller attenuates is more remarkable than the quantity by which the electric potential of the second squeezing roller attenuates.

Now, the present invention will be described further by way of examples.

EXAMPLE 5

Table 2 below shows some of the parameters including the applied bias voltages of Example 5. An image carrier 10 having ø78 is driven at a rotational speed of 210 mm/sec and electrically charged to show a potential of 600V. When the temperature is 25° C., 440 V is applied to the first image carrier squeezing roller 13Y by the bias voltage $Vs_1$ application means 110 and 410 V is applied to the second image carrier squeezing roller 13Y' by the bias voltage $Vs_2$ application means 120. When 35° C. is detected by the temperature detection means 9, only the bias voltage being applied to the first image carrier squeezing roller 13Y by the first bias voltage $Vs_1$ application means 110 is modified. When 15° C. is detected by the temperature detection means 9, only the bias voltage being applied to the second image carrier squeezing roller 13Y' by the second bias voltage $Vs_2$ application means 120 is modified. In this way, the fogging toner on the photosensitive body can be efficiently removed by modifying either one of the bias voltages being applied to the squeezing rollers.

TABLE 2

| | Example 5 | | |
|---|---|---|---|
| environment (temperature, humidity) | 23° C., 65% | 35° C., 65% | 15° C., 44% |
| rotational speed of image carrier (outermost periphery) | 210 mm/sec | 210 mm/sec | 210 mm/sec |
| development roller bias voltage | 480 V | 480 V | 480 V |
| bias voltage $Vs_1$ | 440 V | 430 V | 440 V |
| bias voltage $Vs_2$ | 410 V | 410 V | 430 V |

EXAMPLE 6

Table 3 below shows some of the parameters including the applied bias voltages of Example 6. An image carrier 10 having ø78 is provided with first through fourth squeezing rollers, to which bias voltages $Vs_1$, $Vs_2$, $Vs_3$ and $Vs_4$ are applied respectively. As a result of providing four squeezing rollers, the squeezing operation can be conducted to show an improved efficiency and the fogging toner on the photosensitive body can be removed highly efficiently.

TABLE 3

| | Example 6 |
|---|---|
| environment (temperature, humidity) | 23° C., 55% |
| rotational speed of image carrier (outermost periphery) | 210 mm/sec |
| development roller bias voltage | 550 V |
| bias voltage $Vs_1$ | 500 V |
| bias voltage $Vs_2$ | 470 V |
| bias voltage $Vs_3$ | 450 V |
| bias voltage $Vs_4$ | 440 V |

EXAMPLE 7

Table 4 below shows some of the parameters including the applied bias voltages of Example 7. A negatively charged organic photoconductor is employed as image carrier 10 and the bias voltages listed below are selected to collect fogging toner by means of each of the squeezing rollers to find that fogging toner can be collected efficiently.

TABLE 4

| | Example 7 |
|---|---|
| environment (temperature, humidity) | 23° C., 55% |
| rotational speed of image carrier (outermost periphery) | 210 mm/sec |
| development roller bias voltage | −500 V |
| bias voltage $Vs_1$ | −470 V |
| bias voltage $Vs_2$ | −450 V |

While the present invention is described by way of various embodiments, it will be apparent to those skilled in the art that other embodiments can be realized by appropriately combining components selected from the above-described embodiments without departing from the scope of the present invention.

What is claimed is:

1. An image forming apparatus comprising:

an image carrier that carries an image;

a charging section that electrically charges the image carrier;

an exposure section that exposes the image carrier to light to form a latent image;

a development section that develops the latent image by means of a liquid developer containing carrier and toner particles;

a first squeezing roller that is held in contact with the image carrier carrying the image developed by the development section and adapted to bear a bias voltage $Vs_1$ applied thereto;

a second squeezing roller that is held in contact with the image carrier squeezed by the first squeezing roller adapted to bear a bias voltage $Vs_2$ applied thereto; and a transfer member that is held in contact with the image carrier squeezed by the second squeezing roller and adapted to receive the image transferred thereto;

an absolute value of the bias voltage $Vs_1$ and an absolute value of the bias voltage $Vs_2$ showing a relationship of $|Vs_1|>|Vs_2|$.

2. An image forming apparatus comprising:

an image carrier that carries an image;

a charging section that electrically charges the image carrier;

an exposure section that exposes the image carrier to light to form a latent image;

a development section that includes a developer carrier held in contact with the image carrier to develop the latent image by means of a liquid developer containing carrier and toner particles and adapted to bear a development bias voltage Vd applied thereto;

a first squeezing roller that is held in contact with the image carrier carrying the image developed by the developer carrier and adapted to bear a bias voltage $Vs_1$ applied thereto;

a second squeezing roller that is held in contact with the image carrier squeezed by the first squeezing roller and adapted to bear a bias voltage $Vs_2$ applied thereto; and a transfer member held in contact with the image carrier squeezed by the second squeezing roller and adapted to receive the image transferred thereto;

an absolute value of the development bias voltage Vd, an absolute value of the bias voltage $Vs_1$ and an absolute value of the bias voltage $Vs_2$ showing a relationship of $||Vd|-|Vs_1||>||Vs_1|-|Vs_2||$.

3. The apparatus according to claim 1 or 2, further comprising:

a temperature detector that detects temperature; and a bias voltage adjuster that shifts the bias voltage $Vs_1$, according to the temperature detected by the temperature detector.

4. The apparatus according to claim 3, further comprising:

a second bias voltage adjustor that shifts the bias voltage $Vs_2$ according to the temperature detected by the temperature detector.

5. The apparatus according to claim 4, wherein a quantity of a shift in the bias voltage $Vs_1$ is greater than a quantity of a shift in the bias voltage $Vs_2$.

6. The apparatus according to claim 4, further comprising:

a rotational speed regulator that regulates a rotational speed of the image carrier.

7. The apparatus according to claim 6, wherein the bias voltage adjustor changes the bias voltage $Vs_1$ according to the rotational speed of the image carrier regulated by the rotational speed regulator.

8. The apparatus according to claim 7, wherein the second bias voltage adjustor changes the bias voltage $Vs_2$ according to the rotational speed of the image carrier regulated by the rotational speed regulator.

9. The apparatus according to claim 7, wherein the bias voltage adjustor increases the absolute value $|Vs_1|$of the bias voltage in response to an increase of the rotational speed of the image carrier.

10. The apparatus according to claim 1, further comprising:

a third squeezing roller that is held in contact with the image carrier squeezed by the second squeezing roller and adapted to bear a bias voltage $Vs_3$ applied thereto, the absolute value of the bias voltage $Vs_1$, the absolute value of the bias voltage $Vs_2$ and an absolute value of the bias voltage $Vs_3$ showing a relationship of $|Vs_1|>|Vs_2|>|Vs_3|$.

11. An image forming method comprising:

electrically charging an image carrier at a charging section;

forming a latent image by exposing the image carrier to light at an exposure section;

developing the latent image by means of a liquid developer containing carrier and toner particles at a development section having a development roller held in contact with the image carrier;

squeezing the image carrier that carries an image developed by the development roller by means of a first squeezing roller bearing a bias voltage $Vs_1$ applied thereto; and squeezing the image carrier squeezed by the first squeezing roller by means of a second squeezing roller bearing a bias voltage $Vs_2$ applied thereto, an absolute value of the bias voltage $Vs_1$ and an absolute value of the bias voltage $Vs_2$ showing a relationship of $|Vs_1|>|Vs_2|$.

12. The method according to claim 11, further comprising:

detecting temperature by means of a temperature detector; and shifting the bias voltage $Vs_1$ and the bias voltage $Vs_2$ according to the temperature detected by the temperature detector.

13. The method according to claim 12, wherein a quantity of a shift in the bias voltage $Vs_1$ is greater than a quantity of a shift in the bias voltage $Vs_2$.

14. The method according to claim 11, further comprising:

regulating a rotational speed of the image carrier by means of a rotational speed regulator; and shifting the bias voltage $Vs_1$ and the bias voltage $Vs_2$ according to the rotational speed of the image carrier regulated by the rotational speed regulator.

15. The method according to claim 14, wherein a quantity of the shift in the bias voltage $Vs_1$ is greater than the quantity of the shift in the bias voltage $Vs_2$.

* * * * *